US011768452B2

(12) United States Patent
Takayanagi

(10) Patent No.: US 11,768,452 B2
(45) Date of Patent: Sep. 26, 2023

(54) IMAGE FORMING APPARATUS

(71) Applicant: CANON KABUSHIKI KAISHA, Tokyo (JP)

(72) Inventor: Hiroki Takayanagi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/706,391

(22) Filed: Mar. 28, 2022

(65) Prior Publication Data

US 2022/0317600 A1 Oct. 6, 2022

(30) Foreign Application Priority Data

Mar. 31, 2021 (JP) ..... 2021-060650

(51) Int. Cl.
*G03G 15/16* (2006.01)
*G03G 15/00* (2006.01)

(52) U.S. Cl.
CPC ..... *G03G 15/1675* (2013.01); *G03G 15/5004* (2013.01); *G03G 15/5041* (2013.01); *G03G 15/5058* (2013.01); *G03G 15/5062* (2013.01)

(58) Field of Classification Search
CPC ..... G03G 15/1675; G03G 15/5054; G03G 15/5058; G03G 15/5062; G03G 15/5041
See application file for complete search history.

(56) References Cited

U.S. PATENT DOCUMENTS

2008/0003002 A1* 1/2008 Julien ..... G03G 15/5062 399/49
2012/0269526 A1* 10/2012 Lee ..... G03G 15/0131 399/49
2013/0039673 A1* 2/2013 Nakao ..... G03G 15/5062 399/49
2020/0242428 A1* 7/2020 Omata ..... G06K 15/021
2022/0091552 A1* 3/2022 Kakehi ..... G03G 15/1675
2022/0197192 A1* 6/2022 Kobayashi ..... G03G 15/1665

FOREIGN PATENT DOCUMENTS

JP 2013037185 A 2/2013
JP 2018004828 A 1/2018
JP 2020118932 A 8/2020
JP 2021009346 A 1/2021

* cited by examiner

*Primary Examiner* — Carla J Therrien
(74) *Attorney, Agent, or Firm* — Canon U.S.A., Inc. I.P. Division

(57) ABSTRACT

An image forming apparatus includes an image carrier, an image forming unit, an intermediate transfer belt, a power supply, a transfer member to transfer toner image on the intermediate transfer belt to a recording medium, and a sensor to detect, as density information, a density of the recording medium toner image. In an adjustment mode, (i) a test recording medium is output as a test chart by applying multiple levels of test voltages to the transfer member to transfer test toner images to the test recording medium, (ii) the transferred test toner images are detected via the sensor, and (iii) a transfer voltage is adjusted based on the sensor detection. In the adjustment mode, test toner image groups are set, one test toner image group is extracted based on an index value, and the transfer voltage is adjusted based on the density information of the extracted test toner image group.

8 Claims, 14 Drawing Sheets

FIG. 14

| | | WATER CONTENT IN AMBIENT ATMOSPHERE (g/kg) | | | | |
|---|---|---|---|---|---|---|
| | | 0.9 OR LESS | ··· | 8.9 | ··· | 21.5 OR GREATER |
| PAPER BASIS WEIGHT ($g/m^2$) | · | · | | · | | · |
| | · | · | | · | | · |
| | 81 – 100 | 1000 V | ··· | 500 V | ··· | 200 V |
| | 101 – 125 | 1150 V | ··· | 600 V | ··· | 250 V |
| | 126 – 150 | 1300 V | ··· | 700 V | ··· | 300 V |
| | · | · | | · | | · |
| | · | · | | · | | · |

IMAGE FORMING APPARATUS

BACKGROUND

Field

The present disclosure relates to an image forming apparatus that forms an image by transferring a toner image onto a recording medium.

Description of the Related Art

In image formation performed by, for example, an electrophotographic method, a toner image is electrostatically transferred from an image carrier such as a photoconductor or an intermediate transfer member onto a recording medium such as paper. Such transfer is often performed by applying a transfer voltage to a transfer member such as a transfer roller that is in contact with the image carrier to form a transfer portion.

Japanese Patent Laid-Open No. 2013-37185 discloses an image forming apparatus having a secondary transfer voltage adjustment mode.

In the secondary transfer voltage adjustment mode, multiple patch images are output on a single recording medium and respective voltages are applied to the patches. The density of each of the patches is detected, and optimum secondary transfer voltage conditions are selected on the basis of a result of the detection.

However, when the secondary transfer voltage conditions are selected on the basis of a result of detection of the density of each of the patches, the case sometimes arises where an image defect called "white void" in which an image is partly left blank occurs because of an excessive secondary transfer voltage. In contrast, the case also arises where a density becomes low because of insufficiency of a secondary transfer voltage.

In the secondary transfer voltage adjustment mode, for example, the method has sometimes been employed of outputting patch images while sequentially changing a secondary transfer voltage from a low voltage to a high voltage and deciding a voltage applied when the change in density becomes small during the increase in density as an optimum secondary transfer voltage. The reason for this is that the decision of an excessive secondary transfer voltage is avoided in the secondary transfer voltage adjustment mode. However, since the density varies for various reasons, the case sometimes arises where a secondary transfer voltage, which is actually insufficient, is decided as a voltage at which the change in density is small and is unfortunately decided as an optimum secondary transfer voltage. In contrast, if a secondary transfer voltage when a high-density patch is output in the secondary transfer voltage adjustment mode among multiple patch images is decided as a secondary transfer voltage to avoid the insufficiency of the secondary transfer voltage, the decision of an excessive secondary transfer voltage sometimes occurs. Thus, the "white void" sometimes occurs.

SUMMARY

The present disclosure provides an image forming apparatus capable of preventing the setting of an excessive transfer voltage while suppressing the occurrence of insufficient transfer. Multiple groups, each including at least two or more test patterns, are set. Based on a result of detection performed upon test patterns included in each of the groups, one of the groups is selected. Based on the test patters included in the selected one of the groups, a transfer voltage to be applied at the time of image information is set.

According to an aspect of the present disclosure, an image forming apparatus includes an image carrier configured to carry a toner image, an image forming unit configured to form the toner image on the image carrier, an intermediate transfer belt on which the toner image formed on the image carrier is transferred, a transfer member configured to transfer the toner image transferred on the intermediate transfer belt on a recording medium, a power supply configured to apply a transfer voltage to the transfer member, a sensor configured to detect, as density information, a density of the toner image formed on the recording medium, and a control unit configured to execute an adjustment mode in which, in a non-image formation period, (i) a test recording medium is output as a test chart on which a plurality of test toner images are transferred by applying a test voltage to the transfer member while increasing or decreasing the test voltage in a stepwise manner to apply test voltages of a plurality of levels to the transfer member, (ii) the plurality of test toner images transferred on the test chart are subjected to detection performed by the sensor, and (iii) a transfer voltage to be applied to the transfer member when the toner image is transferred from the intermediate transfer belt on the recording medium is adjusted based on a result of the sensor detection, wherein, in the adjustment mode, the control unit sets a plurality of groups of at least two or more adjacent test toner images, extracts one of the plurality of groups based on an index value acquired from a result of detection that the sensor performs upon respective test toner images included in each of the plurality of groups, and adjusts the transfer voltage based on the density information of test toner images included in the extracted one of the plurality of groups.

Further features of the present disclosure will become apparent from the following description of exemplary embodiments with reference to the attached drawings.

BRIEF DESCRIPTION OF THE DRAWINGS

FIG. 14 is a diagram illustrating an example of the table data of a recording medium shared voltage.

DESCRIPTION OF THE EMBODIMENTS

A first embodiment will be described in detail below with reference to FIGS. 1 to 3. In this embodiment, a tandem-type full-color printer will be described as an example of an image forming apparatus 1.

However, the present disclosure is not limited the tandem-type image forming apparatus 1, and may be applied to other types of image forming apparatuses. In addition, the present disclosure is not limited to a full-color printer, and may be applied to a monochrome or monocolor printer. The present disclosure can be carried out in various uses such as a printer, various printing machines, a copier, a fax machine, and a multi-function machine.

Figure 1:
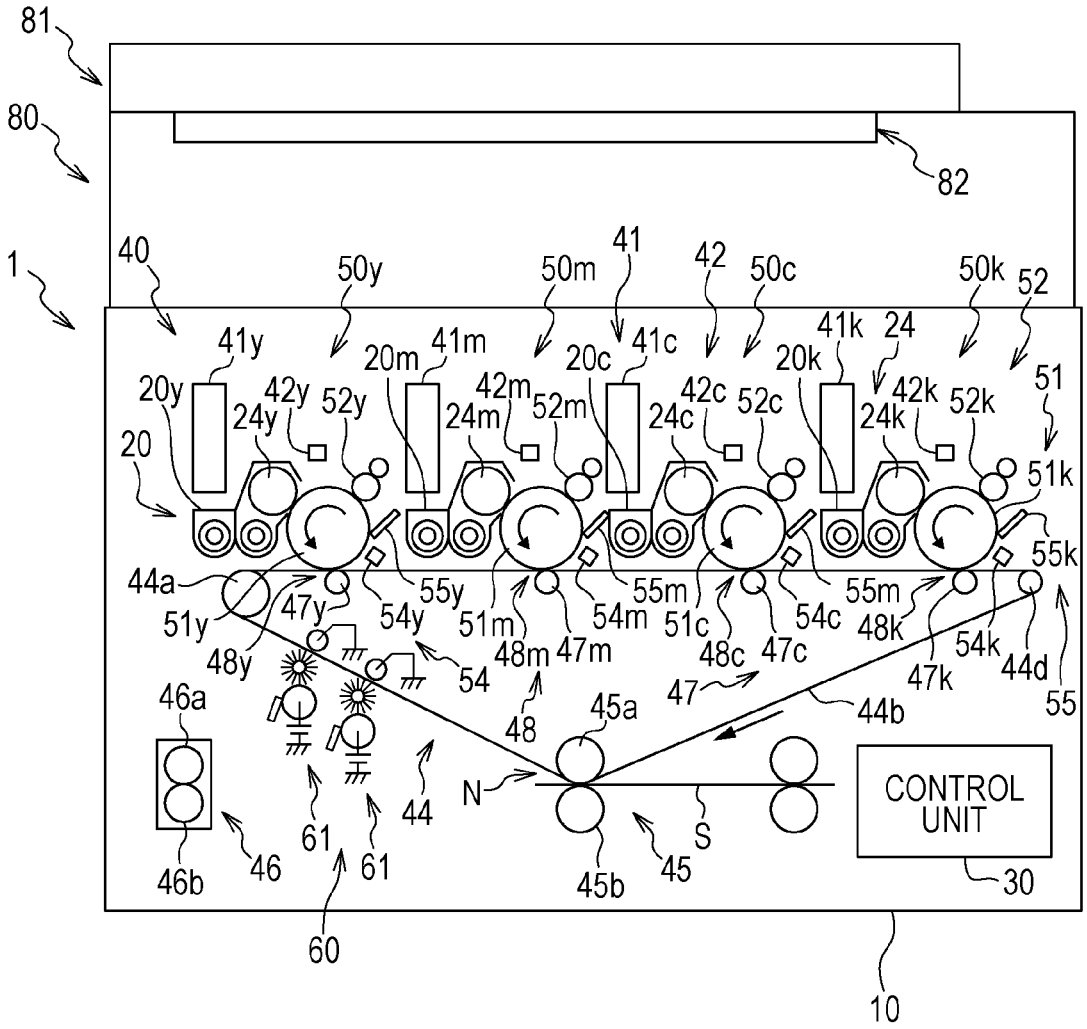
FIG. 1 is a diagram describing an image forming apparatus according to an embodiment.
Figure 2:
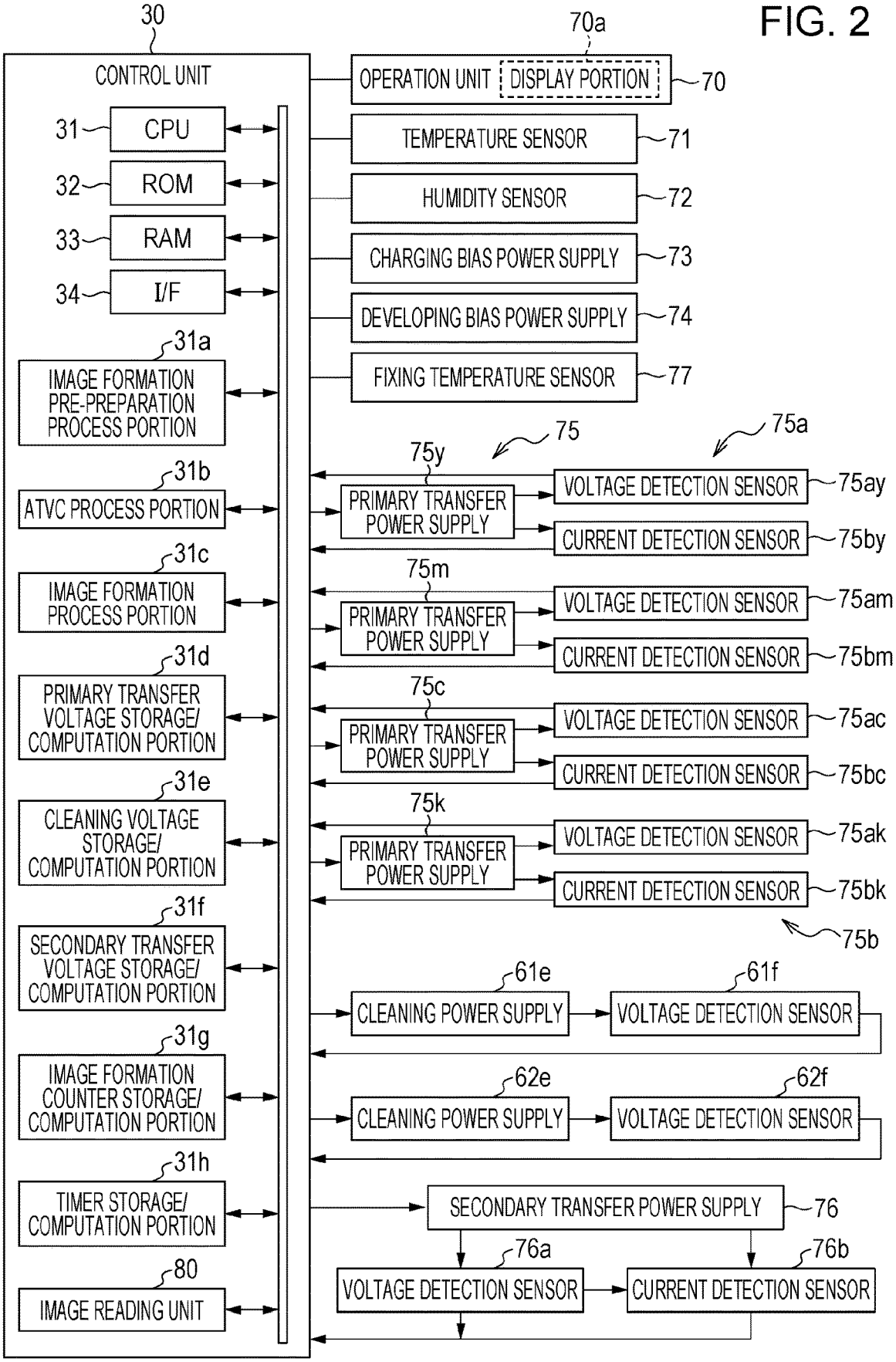
FIG. 2 is a block diagram in an embodiment.
Figure 3:
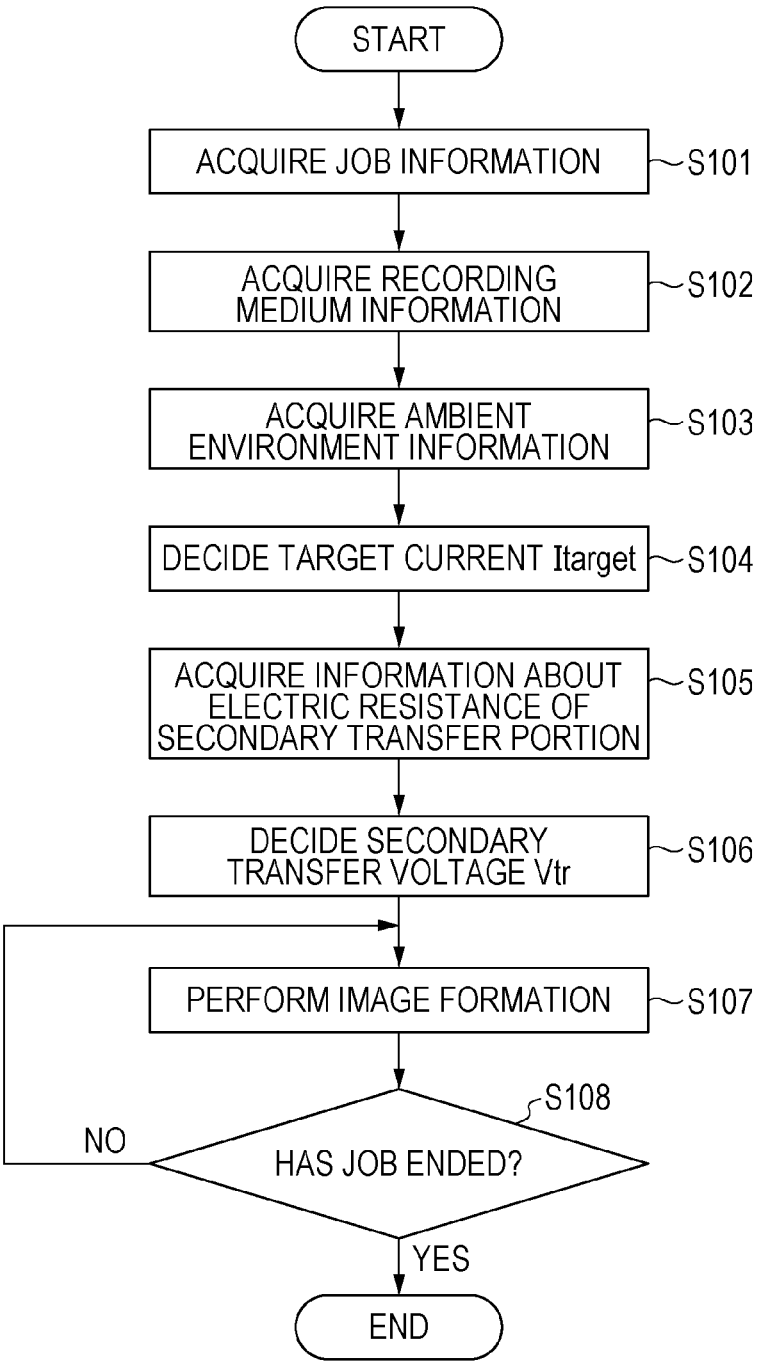
FIG. 3 is a flowchart of secondary transfer control in an embodiment.

As illustrated in FIGS. 1 and 2, the image forming apparatus 1 includes an apparatus body 10, a sheet feeding unit (not illustrated), an image forming unit 40, a sheet discharging unit (not illustrated), a control unit 30 serving as a controller, and an operation unit 70 (see FIG. 2). Inside the apparatus body 10, a temperature sensor 71 (see FIG. 2) capable of detecting a temperature inside the apparatus and a humidity sensor 72 (see FIG. 2) capable of detecting a humidity inside the apparatus are provided. The image forming apparatus 1 can form a 4-color full-color image on a recording medium in accordance with an image signal supplied from an image reading unit 80 serving as a reader, a host apparatus such as a personal computer, or an external apparatus such as a digital camera or a smartphone. Concrete examples of a sheet S serving as a recording medium on which a toner image is formed include plain paper, synthetic resin sheets which are substitutes for plain paper, thick paper, and overhead projector sheets.

The image forming unit 40 can form an image on the sheet S fed from the sheet feeding unit on the basis of image information. The image forming unit 40 includes image forming portions 50*y*, 50*m*, 50*c*, and 50*k*, toner bottles 41*y*, 41*m*, 41*c*, and 41*k*, exposure devices 42*y*, 42*m*, 42*c* and 42*k*, an intermediate transfer portion 44 serving as an image carrier, a secondary transfer device 45, and a fixing portion 46. The image forming apparatus 1 according to this embodiment is capable of forming a full-color image and includes the image forming portions 50*y* for yellow (y), 50*m* for magenta (m), 50*c* for cyan (c), and 50*k* for black (k) that have the same configuration and are provided separately. In FIG. 1, respective constituent elements for four colors have corresponding color identifiers following corresponding reference numerals. However, in the specification, the constituent elements are described using only the reference numerals without the color identifies in some cases. The image forming apparatus 1 can also form a single-color or multi-color image, such as a monochrome black image by using the image forming portion 50 for a desired single color or some of four colors.

The image forming portion 50 includes a photoconductive drum 51 movable while carrying a toner image, a charging roller 52, a developing device 20, a pre-exposure device 54, and a cleaning blade 55. The image forming portion 50 is integrally assembled into a unit as a process cartridge, is mountable and dismountable from the apparatus body 10, and forms a toner image on an intermediate transfer belt 44*b* to be described below.

The photoconductive drum 51 serving as an image carrier is rotatable and carries an electrostatic image used for image formation. In this embodiment, the photoconductive drum 51 is a negatively chargeable organic photoconductor (OPC) of 30 mm in outer diameter and is rotationally driven at a predetermined process speed (peripheral speed) in an arrow direction by a motor (not illustrated). The photoconductive drum 51 is formed of an aluminum cylinder as a base and includes three layers, an undercoating layer, a charge generating layer, and a charge transport layer, sequentially coated and laminated as a surface layer on the surface of the base.

As the charging roller 52 serving as a charger, a rubber roller is used which is rotated by the photoconductive drum 51 in contact with the surface of the photoconductive drum 51 and electrically charges the surface of the photoconductive drum 51 uniformly. A charging bias power supply 73 (see FIG. 2) is connected to the charging roller 52. The charging bias power supply 73 applies a charging bias to the charging roller 52 to charge the photoconductive drum 51 via the charging roller 52. The exposure device 42 is a laser scanner and emits laser light on the basis of image information of separated colors output from the control unit 30.

The developing device 20 develops, with toner, an electrostatic image formed on the photoconductive drum 51 upon application of a developing bias thereto. The developing device 20 includes a developing sleeve 24. The developing device 20 not only accommodates a developer supplied from a toner bottle 41 but also develops an electrostatic image formed on the photoconductive drum 51. The developing sleeve 24 is made of a non-magnetic material, such as aluminum or non-magnetic stainless steel, and is made of aluminum in this embodiment. Inside the developing sleeve 24, a roller-shaped magnet roller is fixedly provided in a non-rotatable state relative to a developer container. The developing sleeve 24 carries a developer including non-magnetic toner and a magnetic carrier and conveys the developer to a developing region opposing the photoconductive drum 51. A developing bias power supply 74 (see FIG. 2) is connected to the developing sleeve 24. The developing bias power supply 74 applies a developing bias to the developing sleeve 24 to develop an electrostatic image formed on the photoconductive drum 51.

A toner image developed on the photoconductive drum 51 is primarily transferred onto the intermediate transfer portion 44. The surface of the photoconductive drum 51 after the primary transfer is destaticized by the pre-exposure device 54. The cleaning blade 55 is of a counter blade type, and is in contact with the photoconductive drum 51 with a predetermined pressing force. After the primary transfer, the toner remaining on the photoconductive drum 51 without being transferred onto the intermediate transfer portion 44 is removed by the cleaning blade 55 provided in contact with the photoconductive drum 51, and then the photoconductive drum 51 prepares for a subsequent image forming process.

The intermediate transfer portion 44 includes a plurality of rollers including a driving roller 44*a*, a follower roller 44*d*, and primary transfer rollers 47*y*, 47*m*, 47*c*, and 47*k*, and includes the intermediate transfer belt 44*b* wound around these rollers and moving while carrying toner images. The follower roller 44*d* is a tension roller for controlling the tension of the intermediate transfer belt 44*b* at a certain level. To the follower roller 44*d*, a force such that the intermediate transfer belt 44*b* is pushed out toward the surface side is applied by the urging force of an urging spring (not illustrated), and by the force, the tension of 2 to 5 kg is exerted in a conveying direction of the intermediate transfer belt 44*b*.

The primary transfer rollers 47*y*, 47*m*, 47*c* and 47*k* are disposed to face photoconductive drums 51*y*, 51*m*, 51*c* and 51*k*, respectively. The primary transfer roller 47 is disposed across the intermediate transfer belt 44*b* from the photoconductive drum 51, and primarily develops a toner image formed on the surface of the photoconductive drum 51 onto the intermediate transfer belt 44*b* at a primary transfer portion 48 upon application of a primary transfer voltage thereto. A primary transfer power supply 75 is connected to the primary transfer roller 47. A voltage detection sensor 75*a* for detecting an output voltage and a current detection sensor 75*b* for detecting an output current are connected to the primary transfer power supply 75 (see FIG. 2). Primary transfer power supplies 75*y*, 75*m*, 75*c*, and 75*k* are provided for the primary transfer rollers 47*y*, 47*m*, 47*c*, and 47*k*, respectively, and primary transfer voltages to be applied to the primary transfer rollers 47*y*, 47*m*, 47*c*, and 47*k* can be separately controlled. The primary transfer roller 47 has, for example, the outer diameter of 15 to 20 mm and has an elastic layer of an ion conductive foamed rubber (NBR rubber) and a core metal. As the primary transfer roller 47, a roller having a resistance value of 1×10^5 to 1×10^8Ω (N/N (23° C., 50% RH) measurement, 2 kV applied) is used.

The intermediate transfer belt 44*b* is rotatable and rotates in the direction of an arrow at a predetermined speed. The intermediate transfer belt 44*b* is in contact with the photoconductive drum 51 to form the primary transfer portion 48 along with the photoconductive drum 51. When a primary transfer voltage is applied from the primary transfer power supply 75 (see FIG. 2) to the primary transfer portion 48, a toner image formed on the photoconductive drum 51 is primarily transferred by the primary transfer portion 48. When a primary transfer voltage with the positive polarity is applied to the intermediate transfer belt 44*b* by the primary transfer roller 47, toner images having respective negative polarities on the photoconductive drum 51 are sequentially transferred onto the intermediate transfer belt 44*b* in a multiplex manner.

The intermediate transfer belt 44*b* is an endless belt having a three-layer structure of a base layer, an elastic layer, and a surface layer from a back surface side. As a material of the base layer, a resin, such as polyimide and polycarbonate, or rubber of various kinds containing appropriate amount of carbon black, which is an antistatic additive, is used, and the base layer has a thickness of 0.05 to 0.15 mm. As a material of the elastic layer, rubber of various kinds, such as urethane rubber and silicone rubber, containing appropriate amount of an ionic conductive agent is used. The elastic layer has a thickness of 0.1 to 0.500 mm. As a material of the surface layer, a resin material such as a fluororesin is used. The surface layer reduces the adhesion force of toner to the surface of the intermediate transfer belt 44*b* to allow the toner to be easily transferred onto the sheet S at a secondary transfer portion N and has a thickness of 0.0002 to 0.020 mm. In this embodiment, for the surface layer, for example, one kind of resin material such as polyurethane, polyester, or an epoxy resin, or two or more kinds of materials of an elastic rubber, elastomer, and butyl rubber is or are used as a base material. Subsequently, for example, one kind or two kinds or more of powder or particles of a fluororesin or the like, or powder or particles with different particle diameters are dispersed to the base material as the material that decreases surface energy to enhance lubricity, so that the surface layer is formed. In this embodiment, a volume resistivity and hardness of the intermediate transfer belt 44*b* are set to 5×10^8 to 1×10^14 [Ω·cm] (at 23° C., 50% RH) and 60 to 85° in MD-1 hardness (at 23° C., 50% RH), respectively. Further, a static friction coefficient is set to 0.15 to 0.6 (measured by type 94i manufactured by HEIDON Shinto Scientific Co. ltd. at 23° C., 50% RH).

A three-layer structure is employed in this embodiment, but a single-layer structure may be employed for which the material of the above base layer is used.

The secondary transfer device 45 includes a secondary transfer inner roller 45*a* and a secondary transfer outer roller 45*b*. The secondary transfer inner roller 45*a* is disposed to face the secondary transfer outer roller 45*b* via the intermediate transfer belt 44*b*. A secondary transfer power supply 76 (see FIG. 2) serving as a high-voltage applying unit is connected to the secondary transfer outer roller 45*b*. A voltage detection sensor 76*a* for detecting an output voltage and a current detection sensor 76*b* for detecting an output current are connected to the secondary transfer power supply 76 (see FIG. 2).

The secondary transfer power supply 76 applies a direct voltage to the secondary transfer outer roller 45*b* as a secondary transfer voltage. The secondary transfer outer roller 45*b* is in contact with the intermediate transfer belt 44*b* to form the secondary transfer portion N along with the intermediate transfer belt 44*b*. A secondary transfer voltage of an opposite polarity to toner is applied to the secondary transfer portion N, so that the secondary transfer outer roller 45*b* secondarily transfers toner images in a collective manner, which have been primarily transferred and carried by the intermediate transfer belt 44*b*, onto the sheet S supplied to the secondary transfer portion N.

A core metal of the secondary transfer inner roller 45*a* is connected to a ground potential. When the sheet S is supplied to the secondary transfer device 45, a secondary transfer voltage, which is opposite in polarity to a toner image and is being controlled in voltage at a preset level, is applied to the secondary transfer outer roller 45*b*. In this embodiment, for example, a secondary transfer voltage of 500 V to 7 kV is applied, a current of 40 to 120 μA flows, and a toner image on the intermediate transfer belt 44*b* is secondarily transferred onto the sheet S. The case has been described in this embodiment where the secondary transfer power supply 76 applies a direct voltage to the secondary transfer outer roller 45*b* for the application of a secondary transfer voltage to the secondary transfer portion N. However, for example, a direct voltage may be applied to the secondary transfer inner roller 45*a* for the application of a secondary transfer voltage to the secondary transfer portion N.

The secondary transfer outer roller 45*b* has, for example, an outer diameter of 20 to 25 mm, and has an elastic layer of an ion conductive foamed rubber (NBR rubber) and a core metal. As the secondary transfer outer roller 45*b*, a roller having a resistance value of 1×10^5 to 1×10^8Ω (N/N (23° C., 50% RH) measurement, 2 kV applied) is used.

The intermediate transfer portion 44 includes a belt cleaning device 60. The belt cleaning device 60 removes adhesive materials such as toner left on the intermediate transfer belt 44*b* after the secondary transfer process. The belt cleaning device 60 includes electrostatic cleaning portions 61 and 62 to which cleaning voltages of different polarities are applied.

The fixing portion 46 includes a fixing roller 46*a* and a pressing roller 46*b*. The sheet S is nipped and fed between the fixing roller 46*a* and the pressing roller 46*b*, so that a toner image transferred on the sheet S is heated and pressed and is fixed to the sheet S. The temperature of the fixing roller 46*a* is detected by a fixing temperature sensor 77 (see FIG. 2). The sheet discharging unit feeds the sheet S that is conveyed from a discharge route after fixation, and, for example, discharges the sheet S from a discharge port and stacks the sheet S on a discharge tray. A reversing and conveying path (not illustrated) that can turn over the sheet S after fixation and allows the sheet S to pass through the secondary transfer device 45 again is provided between the fixing portion 46 and the discharge port. By operation of the reversing and conveying path, image formation can be performed on both sides of a single sheet.

The upper part of the image forming apparatus 1 includes an automatic document conveyance device 81 that automatically conveys the sheet S on which an image is formed to the image reading unit 80 and the image reading unit 80 that reads the image on the sheet S conveyed by the automatic document conveyance device 81. The image reading unit 80 illuminates the sheet S placed on a platen glass 82 with light from a light source (not illustrated) and reads the image formed on the sheet S using image reading elements (not illustrated) with a predetermined dot density.

As illustrated in FIG. 2, the control unit 30 is configured by a computer, and includes, for example, a CPU 31, a ROM 32 that stores programs that control respective units, a RAM 33 that temporarily stores data, and an input and output circuit (I/F) 34 that externally inputs and outputs signals. The CPU 31 is a microprocessor that manages entire control of the image forming apparatus 1, and is a main body of a system controller. The CPU 31 is connected to the sheet feeding unit, the image forming unit 40, the sheet discharging unit, the operation unit 70 via the input and output circuit 34, exchanges signals with the respective units, and controls operations. An image formation control sequence or the like for forming an image on the sheet S is stored in the ROM 32. The charging bias power supply 73, the developing bias power supply 74, the primary transfer power supply 75, and the secondary transfer power supply 76 are connected to the control unit 30 and are controlled by signals from the control unit 30. The temperature sensor 71, the humidity sensor 72, the voltage detection sensor 75*a* and the current detection sensor 75*b* for the primary transfer power supply 75, the voltage detection sensor 76*a* and the current detection sensor 76*b* for the secondary transfer power supply 76, and the fixing temperature sensor 77 are connected to the control unit 30. Signals detected by the respective sensors are input to the control unit 30.

The operation unit 70 includes an operation button and a display portion 70*a* including a liquid crystal panel. A user can execute a print job by operating the operation unit 70. Upon receiving a signal from the operation unit 70, the control unit 30 operates various devices in the image forming apparatus 1.

In this embodiment, the control unit 30 includes an image formation pre-preparation process portion 31*a*, an ATVC process portion 31*b*, and an image formation process portion 31*c*. The control unit 30 includes a primary transfer voltage storage/computation portion 31*d*, a cleaning voltage storage/computation portion 31*e*, a secondary transfer voltage storage/computation portion 31*f*, an image formation counter storage/computation portion 31*g*, and a timer storage/computation portion 31*h*. Each of these process portions and storage/computation portions may be provided as a portion or portions of the CPU 31 or the RAM 33. The control unit 30 can switch between a multiple color mode in which a primary transfer voltage is applied to the multiple primary transfer portions 48 and image formation is performed with multiple colors and a single color mode in which a primary transfer voltage is applied to only one of the multiple primary transfer portions 48 and image formation is performed with a single color and execute the mode.

Next, an image forming operation performed by the image forming apparatus 1 having the above configuration will be described.

When the image forming operation starts, first, the photoconductive drum 51 rotates and the surface thereof is electrically charged by the charging roller 52. Subsequently, on the basis of image information, laser light is emitted from the exposure device 42 to the photoconductive drum 51, so that an electrostatic image is formed on the surface of the photoconductive drum 51. Toner is deposited on this electrostatic image, so that the electrostatic image is developed and visualized as a toner image, and then the toner image is transferred onto the intermediate transfer belt 44*b*.

On the other hand, the sheet S is supplied in parallel with such a toner image forming operation and is conveyed to the secondary transfer device 45 by being timed to toner images on the intermediate transfer belt 44*b*. Subsequently, the images are transferred from the intermediate transfer belt 44*b* onto the sheet S. The sheet S is conveyed to the fixing portion 46, in which unfixed toner image is heated and pressed and is fixed to the surface of the sheet S, and is then discharged from the apparatus body 10.

Control of Secondary Transfer Voltage

Next, the control of a secondary transfer voltage will be described in detail with reference to FIGS. 2 and 3. In general, the control of a secondary transfer voltage includes constant-voltage control and constant-current control. In this embodiment, the constant-voltage control is used.

First, the control unit 30 initiates an operation of a job when acquiring information about a job from the operation unit 70 or an external device (not illustrated) (S101). The information about a job includes image information designated by an operator, the size (width and length) of the sheet S on which an image is to be formed, information (thickness or basis weight) regarding the thickness of the sheet S, and information regarding the surface property of the sheet S (e.g., information about whether the sheet S is coated paper). That is, the job information includes information about the size of a recording medium and information about the category of type of a recording medium. The control unit 30 writes this job information in the RAM 33 (S102).

Subsequently, the control unit 30 acquires environmental information detected by the temperature sensor 71 and the humidity sensor 72 (S103). The ROM 32 stores information representing the correlation between the environmental information and a target current Itarget for transferring a toner image from the intermediate transfer belt 44*b* onto the sheet S. On the basis of the environmental information read in S103, the control unit 30 acquires the target current Itarget corresponding to the environment from the information representing the correlation between the environmental information and the target current Itarget and writes this target current Itarget in the RAM 33 (S104). The reason why the target current Itarget is changed on the basis of the environmental information is that a toner charge amount varies depending on an environment. The information representing the correlation between the environmental information and the target current Itarget has been acquired in advance by experiment or the like.

Subsequently, the control unit 30 performs active transfer voltage control (ATVC) before a toner image on the intermediate transfer belt 44*b* and the sheet S onto which the toner image is transferred reach the secondary transfer portion N (S105). That is, in a state in which the secondary transfer outer roller 45*b* and the intermediate transfer belt 44*b* are in contact with each other, predetermined voltages of multiple levels are supplied from the secondary transfer power supply 76 to the secondary transfer outer roller 45*b*. Subsequently, current values when the predetermined voltages are applied are detected by the current detection sensor 76*b*, and a relationship between a voltage and a current (voltage-current characteristic) is acquired. This relationship between a voltage and a current changes depending on the electric resistance of the secondary transfer portion N. In the configuration according to this embodiment, the relationship between a voltage and a current is not such that a current linearly changes relative to a voltage (i.e., is linearly proportional to a voltage), but is such that a current changes as represented by a polynomial expression consisting of two or more terms of a voltage. Accordingly, in this embodiment, in order that the relationship between a voltage and a current can be represented by a polynomial expression, the number of steps of a predetermined voltage or current supplied when the information about the electric resistance of the secondary transfer portion N is acquired is three or more.

Subsequently, the control unit 30 acquires the value of a voltage to be applied from the secondary transfer power supply 76 to the secondary transfer outer roller 45*b* (S106). That is, on the basis of the target current Itarget written in the RAM 33 in S104 and the relationship between a voltage and a current acquired in S105, the control unit 30 acquires a voltage value Vb required to cause the target current Itarget to flow in a state in which the sheet S is absent in the secondary transfer portion N. The ROM 32 stores information for acquiring a recording medium shared voltage Vp illustrated in FIG. 14. In this embodiment, this information is set as table data indicating a relationship between a water content in an ambient atmosphere and the recording medium shared voltage Vp for each of sections of basis weights of the sheet S. The control unit 30 is capable of acquiring an ambient water content on the basis of environmental information (temperature and humidity) detected by the temperature sensor 71 and the humidity sensor 72. On the basis of the information about a job acquired in S101 and the environmental information acquired in S103, the control unit 30 acquires the recording medium shared voltage Vp from the above-described table data. In the case where an adjustment value is set in a simple adjustment mode of a secondary transfer voltage to be described below, an adjustment amount ΔV corresponding to the adjustment value is acquired. The control unit 30 acquires Vb+Vp+ΔV as a secondary transfer voltage Vtr applied from the secondary transfer power supply 76 to the secondary transfer outer roller 45*b* when the sheet S passes through the secondary transfer portion N and writes the secondary transfer voltage Vtr in the RAM 33. The table data for the acquisition of the recording medium shared voltage Vp illustrated in FIG. 14 is acquired in advance by experiment or the like. Here, the recording medium shared voltage (transfer voltage corresponding to the electric resistance of the sheet S) Vp also changes depending on the surface property of the sheet S other than the information regarding the thickness of the sheet S in some cases. Accordingly, the above table data may also be set such that the recording medium shared voltage Vp also changes depending on the information regarding the surface property of the sheet S. In this embodiment, the information regarding the thickness of the sheet S (and, in addition, the information regarding the surface property of the sheet S) are included in the job information acquired in S101. However, a measurement unit for detecting the thickness of the sheet S and the surface property of the sheet S is provided in the image forming apparatus 1, and the recording medium shared voltage Vp may be acquired on the basis of information acquired by this measurement unit.

Subsequently, the sheet S is sent to the secondary transfer portion N, and image formation is performed while the secondary transfer voltage Vtr is applied (S107). Subsequently, the control unit 30 repeats the processing of S107 until all the images in the job are transferred onto the sheet S and are output (S108).

Simple Adjustment Mode of Secondary Transfer Voltage

Next, a simple adjustment mode of a secondary transfer voltage will be described.

Depending on the type of the sheet S used by a user, the water content and electrical resistance value of the sheet S may greatly differ from those of a standard recording medium. In this case, optimal transfer may not be performed at the default recording medium shared voltage Vp of the sheet.

More specifically, first, the secondary transfer voltage at which toner on the intermediate transfer member can be transferred needs to be applied. Furthermore, the secondary transfer voltage needs to be set to avoid the occurrence of an abnormal electric discharge when the secondary transfer voltage is increased. Depending on the condition of a recording medium used by a user, the resistance of the recording medium may exceed an estimate and a voltage required for the transfer of toner may be insufficient. In such a case, the secondary transfer voltage needs to be increased.

When there is a high possibility that an electric discharge occurs because of the reduction in a water content in a recording medium, an image defect easily occurs because of an abnormal electric discharge. In this case, the secondary transfer voltage needs to be reduced.

Accordingly, the optimum recording medium shared voltage Vp+ΔV is selected by changing the recording medium shared voltage Vp and performing an image output. This adjustment can be performed in such a manner that a user changes the secondary transfer voltage each time a target image on a sheet is output and checks the image to determine the secondary transfer voltage. However, in this method, since the image output and the setting of the secondary transfer voltage are repeated, the number of wasted recording media increases and it takes time in some cases.

Accordingly, in a non-image formation period, an operation is performed of applying test voltages of multiple levels to the secondary transfer outer roller 45*b*, transferring multiple test toner images onto a recording medium, and outputting a test chart for setting a transfer voltage to be applied at the time of image formation. That is, a simple adjustment mode can be performed. In this mode, a test chart is output which includes thereon test toner images formed by changing the secondary transfer voltage for each patch image of a representative color, and the secondary transfer voltage is determined.

Figure 4:
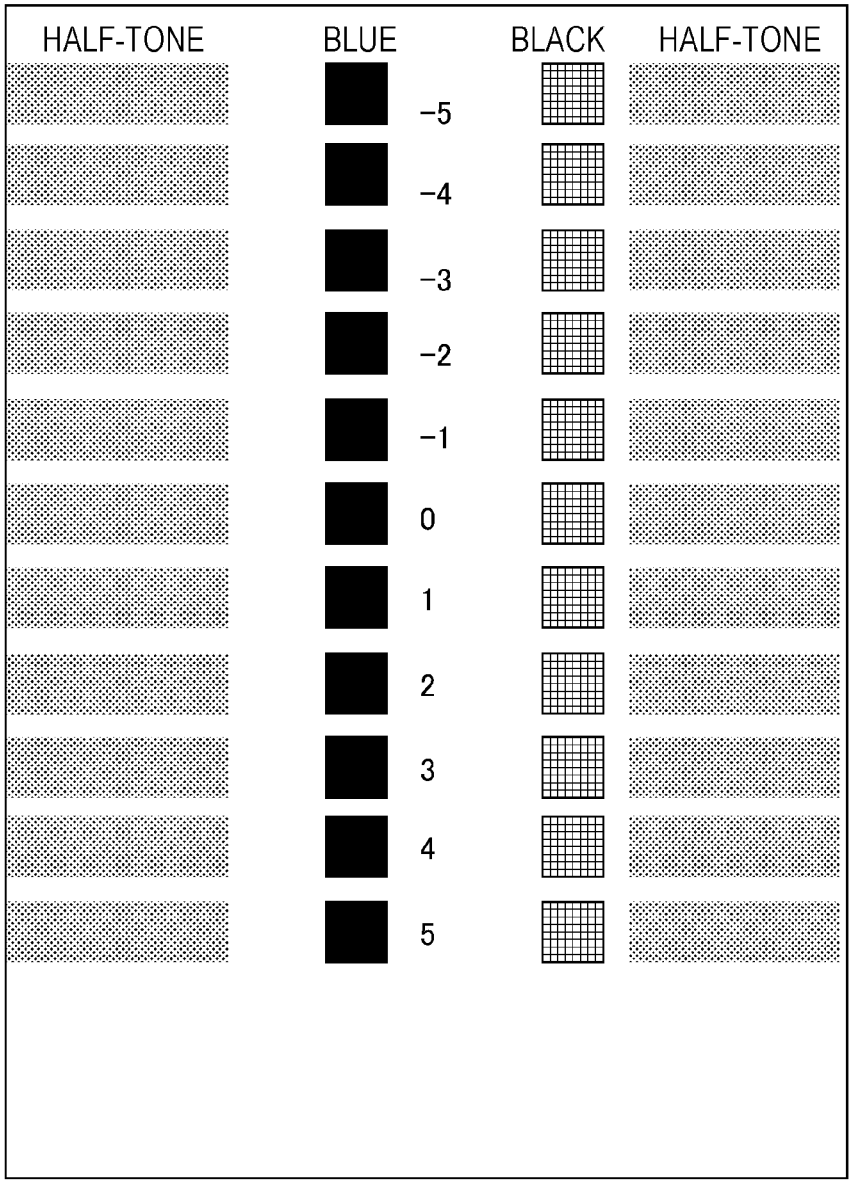
FIG. 4 is a diagram describing an image for adjustment of a secondary transfer voltage in an embodiment.
Figure 5:
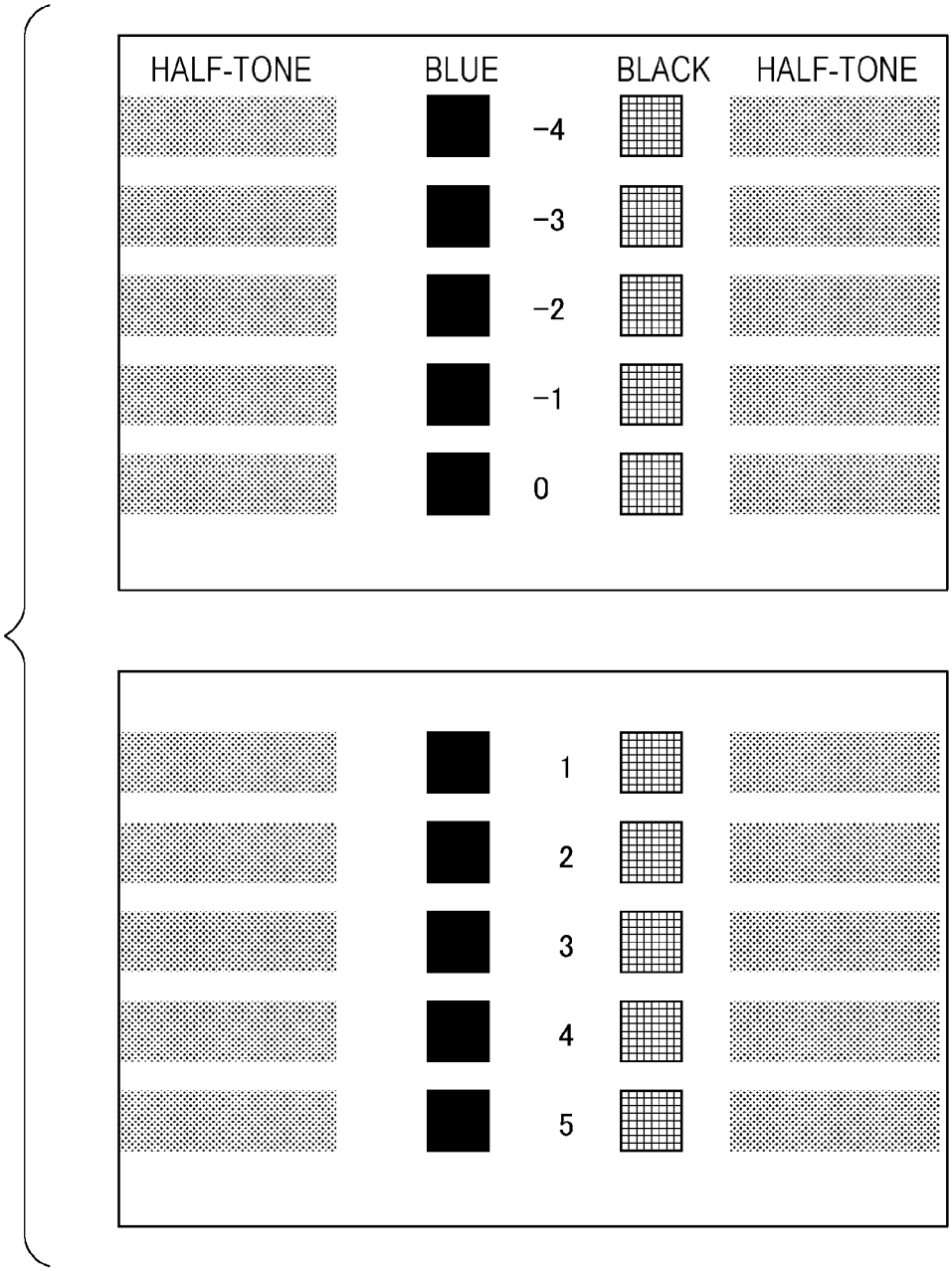
FIG. 5 is a diagram describing an image for adjustment of a secondary transfer voltage in an embodiment.

An image chart in the simple adjustment mode will be described. Two types of charts illustrated in FIGS. 4 and 5 are used. The chart illustrated in FIG. 4 is used when the output of an image onto a recording medium having the length of 420 to 487 mm in a conveying direction is performed. The chart illustrated in FIG. 5 is used when the output of an image onto a recording medium having the length of 210 to 419 mm in a conveying direction is performed.

The size of a patch needs to be set to allow a user to perform easy determination. If the sizes of a solid blue patch and a solid black patch are small, it is difficult for a user to determine the transferability of the solid blue patch and the solid black patch. Accordingly, the sizes of these patches are preferably 10 mm square or greater, and are more preferably 25 mm square or greater.

The maximum size of a recording medium usable in this image forming apparatus is 13 inches×19.2 inches. The image size of the chart illustrated in FIG. 4 corresponds to this size. When the size of a recording medium is less than 13 inches×19.2 inches and is up to the A3 size, this chart is cut and output on, for example, the recording medium of the A3 size of 292×415 mm with a margin of 2.5 mm at each end portion with the leading end center being the reference position. A user can select not only a standard size but also any size.

Blue patches and black patches are each 25.7 mm×25.7 mm square. Each of gray patches at end portions has a length of 25.7 mm in the conveying direction and extends to the end portion of the recording medium in the thrust direction. The interval between the patches in the conveying direction is 9.5 mm, and the secondary transfer voltage is switched therebetween. The eleven patches in the conveying direction are arranged within the length of 387 mm such that they are fit into the A3 size of 415 mm Since there is an image defect that sometimes occurs only at the leading end or the trailing end of a recording medium and this causes a confusion whether the image defect has occurred because of the change in the secondary transfer voltage, no patches are formed at the leading end and the trailing end of the recording medium. When a recording medium is selected whose size in the thrust direction is less than 13 inches, the gray images at the end portions become smaller. The margin at the trailing end in the conveying direction becomes larger.

In the case of a recording medium smaller than the A3 size, the chart illustrated in FIG. 5 corresponds to a size that is the A5 size (longitudinal feed) or larger and smaller than the A3 size. That is, the size of a recording medium is 210 to 419 mm. An image size is 13 inches×210 mm. In the thrust direction, gray patches become smaller in synchronization with the change in the size of a recording medium. In the conveying direction, the output length of the five patches is 167 mm and the margin at the trailing end becomes longer to correspond to the size of the recording medium of 210 to 419 mm.

Only five patches are output on a single recording medium having the size of 210 to 419 mm. Accordingly, in order to increase the number of patches, two recording media are output which include thereon patches obtained with the secondary transfer voltages of −4 to 5.

An adjustment flow will be described with reference to FIG. 6.

Figure 7:
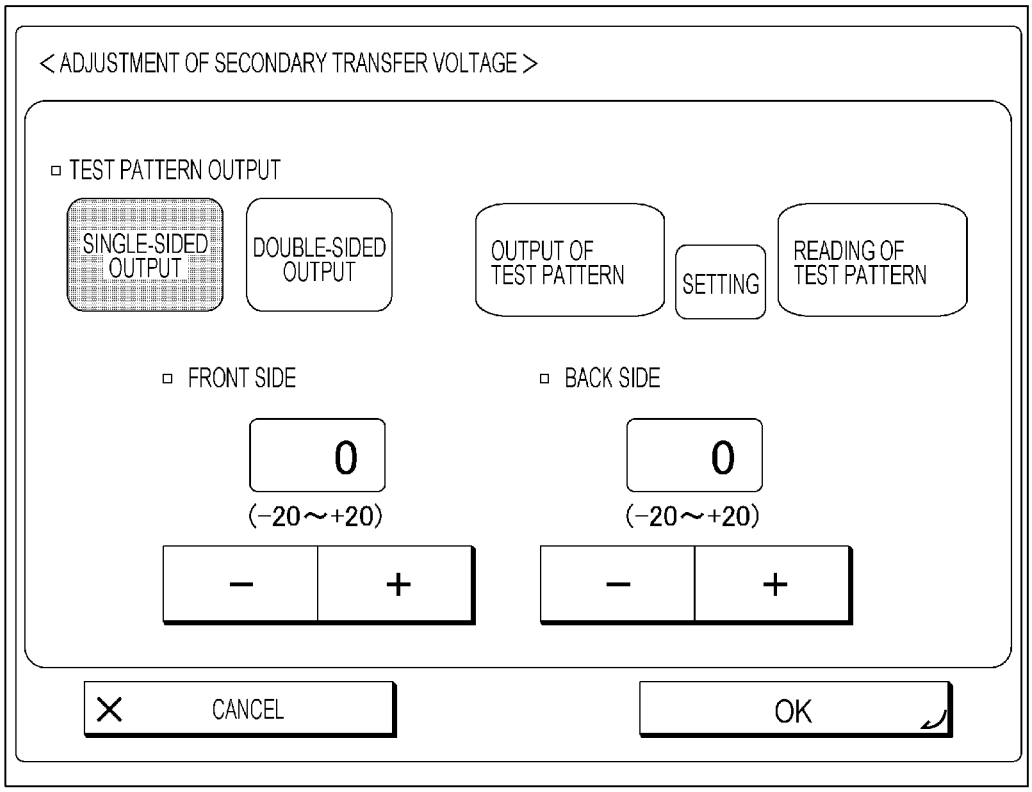
FIG. 7 is a diagram illustrating an exemplary operation screen in the secondary transfer voltage adjustment mode in an embodiment.

First, a user selects a sheet feeding unit (not illustrated) containing a recording medium that is an adjustment target to select a recording medium type and a recording medium size (step S1). Using an adjustment screen illustrated in FIG. 7, the user sets a center voltage and whether to output a test pattern to a single side or both sides of a recording medium (step S2). When the value of zero is selected, a preset voltage set in advance for the recording medium type in an apparatus body is selected. When the adjustment value of zero is selected, eleven patches from −5 to +5 are output with the respective different secondary transfer voltages. The difference in the secondary transfer voltage for one level is 150 V. When a test pattern output button is selected, a polynomial expression of two or more terms (quadratic expression in this embodiment) representing the voltage-current relationship representing information about the electric resistance of the secondary transfer portion N is obtained by an operation similar to the operation in the above ATVC (step S3). By the use of the test pattern output button, eleven patches are output while the secondary transfer voltage is changed every 150 V (step S4). For example, it is assumed that the recording medium shared voltage Vp in this environment is 2500 V and Vb obtained as a result of the ATVC is 1000 V. In this case, image formation is performed while the secondary transfer voltage is changed every 150 V in the range of 2750 V to 4250 V.

Adjustment Flow in Simple Adjustment Mode of Secondary Transfer Voltage

Subsequently, the output test pattern is read by the image reading unit 80 controlled by the CPU 31, and the RGB luminance data (8 bits) at multiple points on each solid blue patch (steps S5 and S6) is acquired. In this embodiment, luminance data at four points on each patch is acquired. That is, a region where a single patch is formed is divided into four, and luminance data in each of the divided regions is acquired.

Figure 8A:
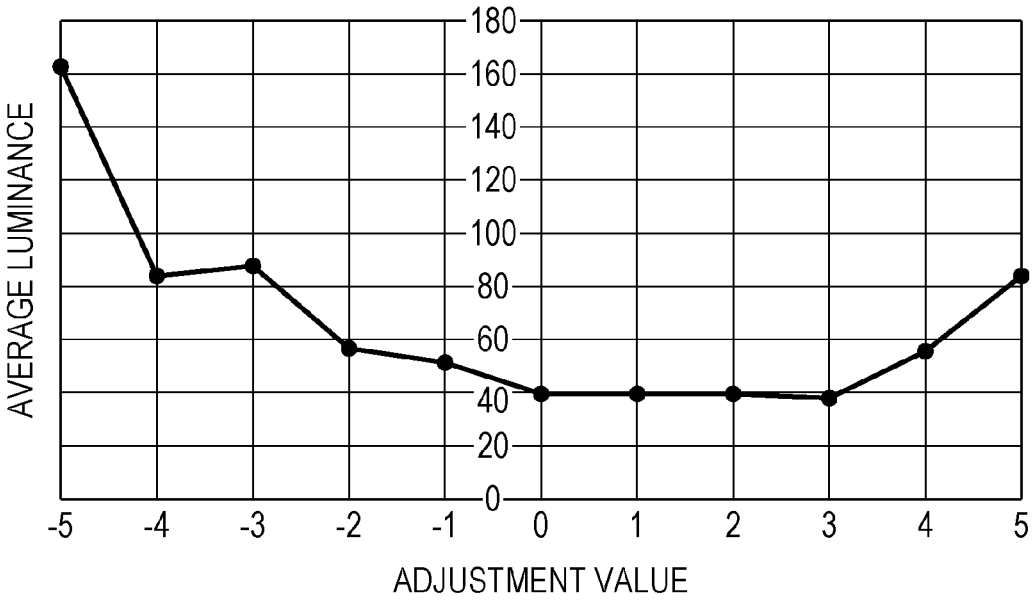
FIGS. 8A and 8B are diagrams describing an example of the secondary transfer voltage adjustment mode in an embodiment.
Figure 8B:
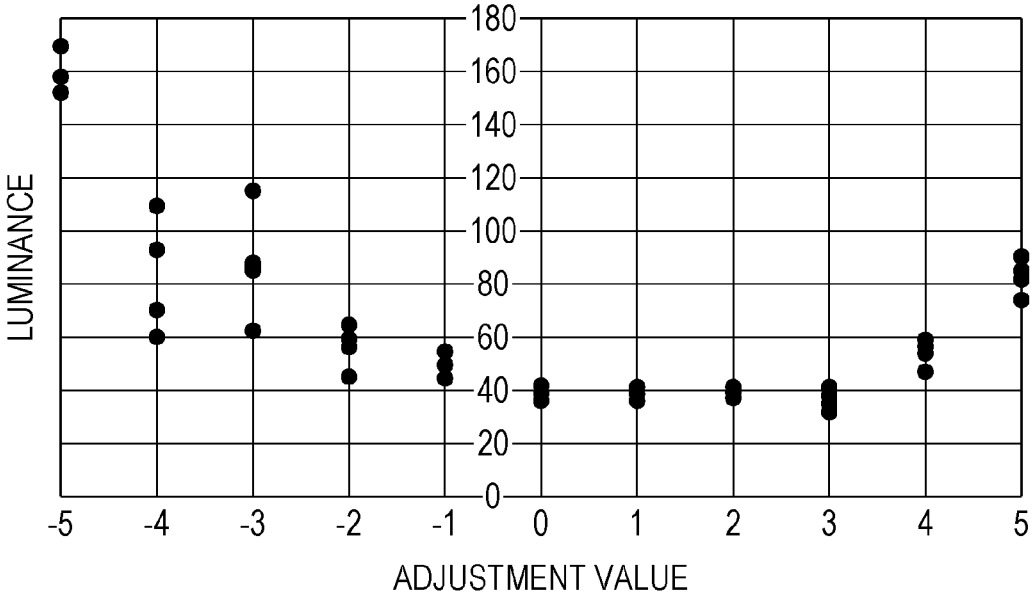

As illustrated in FIG. 8A, in step S6, the change in luminance average of a patch image corresponding to each voltage level (adjustment value) can be derived. As illustrated in FIG. 8A, when a toner image is secondarily transferred onto the sheet S and a density appears, the difference A between luminance averages of adjacent patches reduces like in the case of the adjustment values of 0 to 3. Accordingly, it can be considered that the amount of toner to be secondarily transferred is large when a position is selected where the difference A between luminance averages of adjacent patches is small. Since it is difficult for toner to be secondarily transferred in the case of the adjustment value of −5 with which the severe insufficiency of the secondary transfer voltage occurs as illustrated in FIG. 8A, the difference A from the adjacent adjustment value of −4 is large. However, in the case of the adjustment values of −4 to −2 in a transient state in which the secondary transfer of toner starts, there are large variations in luminance value with respect to an adjustment value as illustrated in FIG. 8B. In particular, even in an unstable region where the amount of toner to be secondarily transferred is likely to be insufficient as represented by the adjustment values of −4 and −3 in FIG. 8A, the difference A between the luminance averages of adjacent patches is small as a result of detection. In this case, if the adjustment value of −3 is automatically decided, the case arises where a density reduces during a job in some cases because the amount of toner to be secondarily transferred is unstable. Accordingly, the adjustment value of 3 with which the lowest luminance value is obtained as illustrated in FIG. 8A has been automatically decided. When an image is output using the adjustment value of 3 with which a luminance average is low, a point at which a density is locally low has sometimes appeared on an image even with the adjustment value. The reason for this is that an electric discharge has started in the secondary transfer portion and part of toner of a polarity reversed from a normal charge polarity has not been transferred.

That is, there is a need to automatically decide an adjustment value without selecting the adjustment values of −5 to −2 illustrated in FIG. 8 with which the level of a secondary transfer voltage becomes low and density becomes unstable and selecting the adjustment value of 3 (or greater values) with which the amount of toner to be secondarily transferred is reduced because of unnecessary electric discharge in the secondary transfer portion.

Adjustment Flow in First Embodiment

Figure 6:
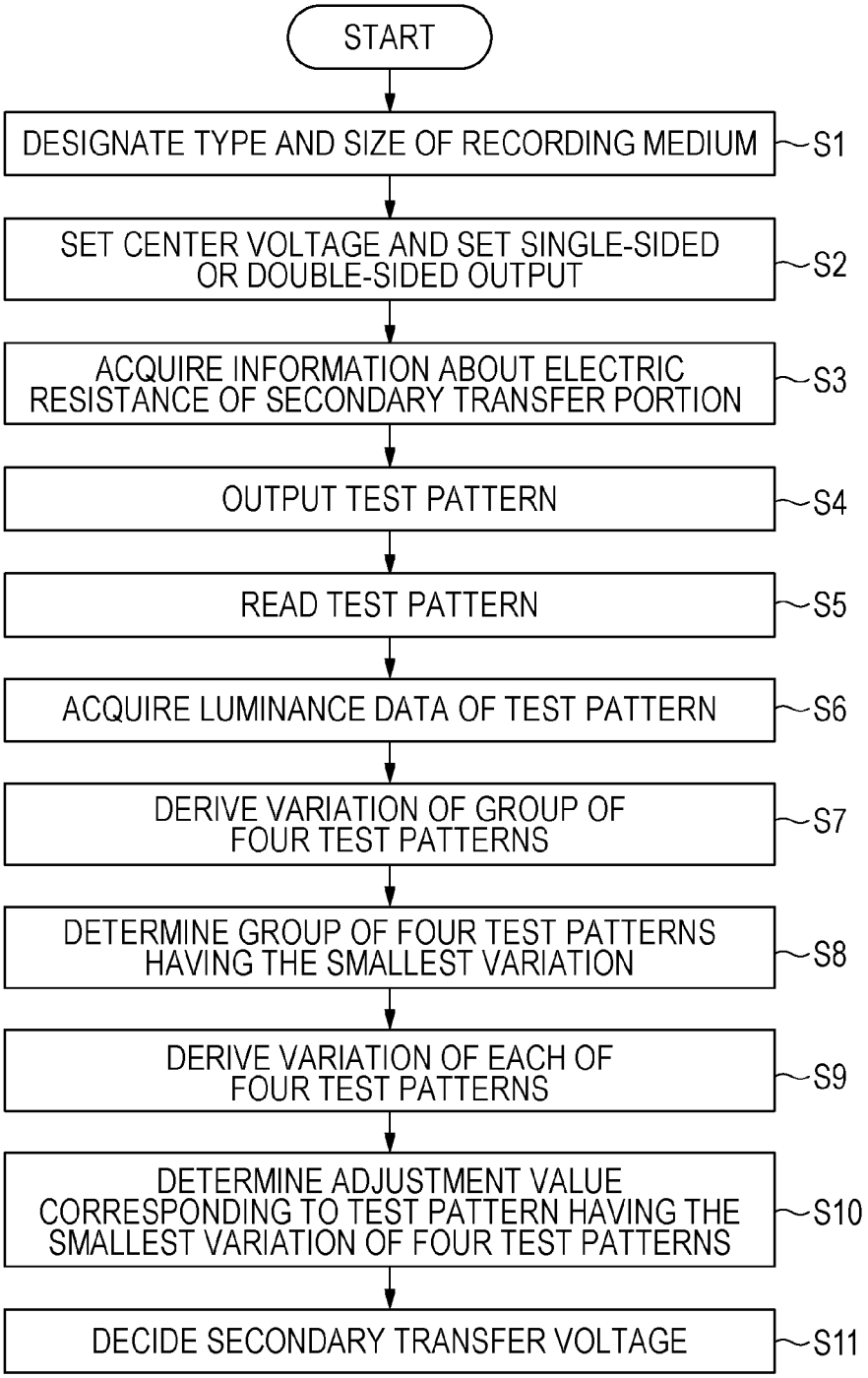
FIG. 6 is a flowchart of a secondary transfer voltage adjustment mode in an embodiment.
Figure 9A:
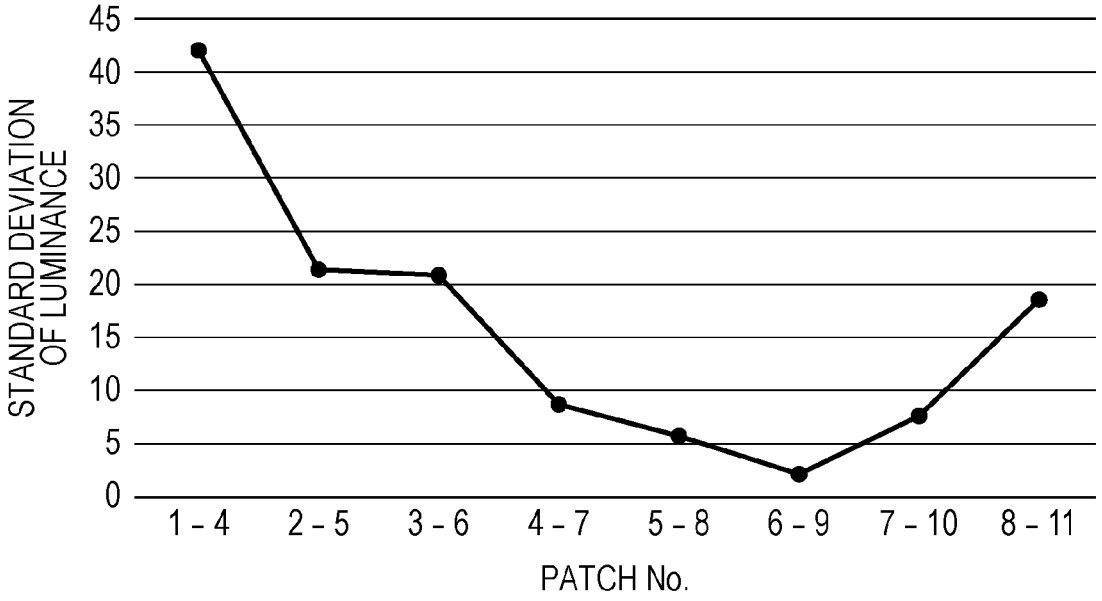
FIGS. 9A and 9B are diagrams describing an example of the secondary transfer voltage adjustment mode in a first embodiment.

In the first embodiment, a standard deviation is derived as the variation in luminance value of a group of four test patterns as illustrated in step S7 in FIG. 6. The sixteen pieces of data of luminance values of four test patterns obtained with the adjustment values of −5 to −2 in FIG. 8 are set as a single group, and a standard deviation is derived using these pieces of data. Subsequently, using the sixteen pieces of data of luminance values of four test patterns obtained with the adjustment values of −4 to −1, a standard deviation is derived. FIG. 9A illustrates the change in the standard deviation. For example, the test patterns obtained with the adjustment values of −5 to −2 correspond to patch No. 1-4 in the horizontal axis in FIG. 9A, the test patterns obtained with the adjustment values of −4 to −1 correspond to patch No. 2-5, and the test patterns obtained with the adjustment values of 2 to 5 correspond to patch No. 8-11. That is, the CPU 31 sets multiple groups each including at least two or more adjacent test patterns (test toner images). The standard deviations of luminance values of the respective groups are plotted in the vertical axis. As illustrated in FIG. 9A, the standard deviation of the luminance value of the group having patch No. 6-9, that is, the group corresponding to the adjustment values of 0 to 3, is the smallest, and this group is determined to be a region where a density is stable (step S8 in FIG. 6). In this embodiment, the group, the standard deviation (variation in density) of which is the smallest of the groups of multiple patches, is selected as a group enabling a stable density. On the basis of luminance information of patches included in the selected group, a secondary transfer voltage is set. In this embodiment, the group with patch No. 6-9, which is the group of test patterns obtained with the adjustment values of 0 to 3, has a small standard deviation of a luminance value and is therefore selected. Among the adjustment values of 0 to 3, the adjustment value of 0 with which the lowest secondary transfer voltage is set may be decided as an optimal secondary transfer voltage, but a process is further performed in this embodiment.

Figure 9B:
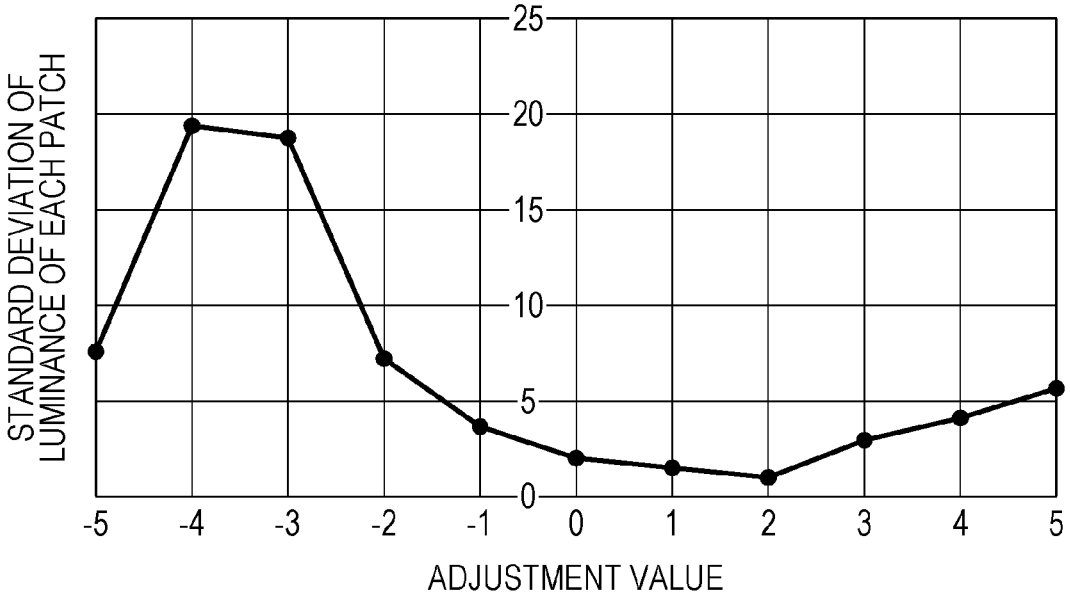

Subsequently, the four standard deviations (variations) of luminance values of the respective test patterns (patches) included in the group (corresponding to the adjustment values of 0 to 3) are derived (step S9 in FIG. 6). FIG. 9B illustrates the change in the standard deviation of four luminance values of each test pattern (patch). It has been determined in step S8 in FIG. 6 that the group corresponding to the adjustment values of 0 to 3 is a region where a density is stable. In this embodiment, it is determined that the adjustment value of 2 in the group is optimum with which the standard deviation (variation) of the luminance value of the test pattern (patch) is the smallest of the four standard deviations of luminance values of the respective test patterns (step S10 in FIG. 6). For example, since the recording medium shared voltage Vp obtained in this environment is 2500 V, Vb obtained as a result of ATVC is 1000 V, and the level of the adjustment value of 1 is 150 V, 3800 V is decided as an optimum secondary transfer voltage for an image formation job (step S11 in FIG. 6).

Figure 10A:
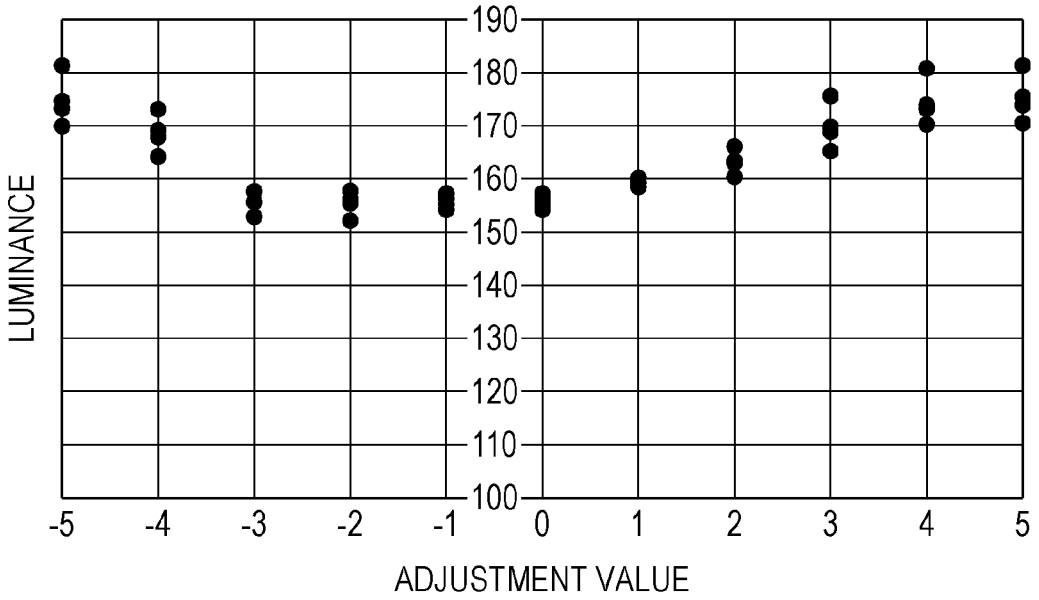
FIGS. 10A and 10B are diagrams describing an example of the secondary transfer voltage adjustment mode in the first embodiment.
Figure 10B:
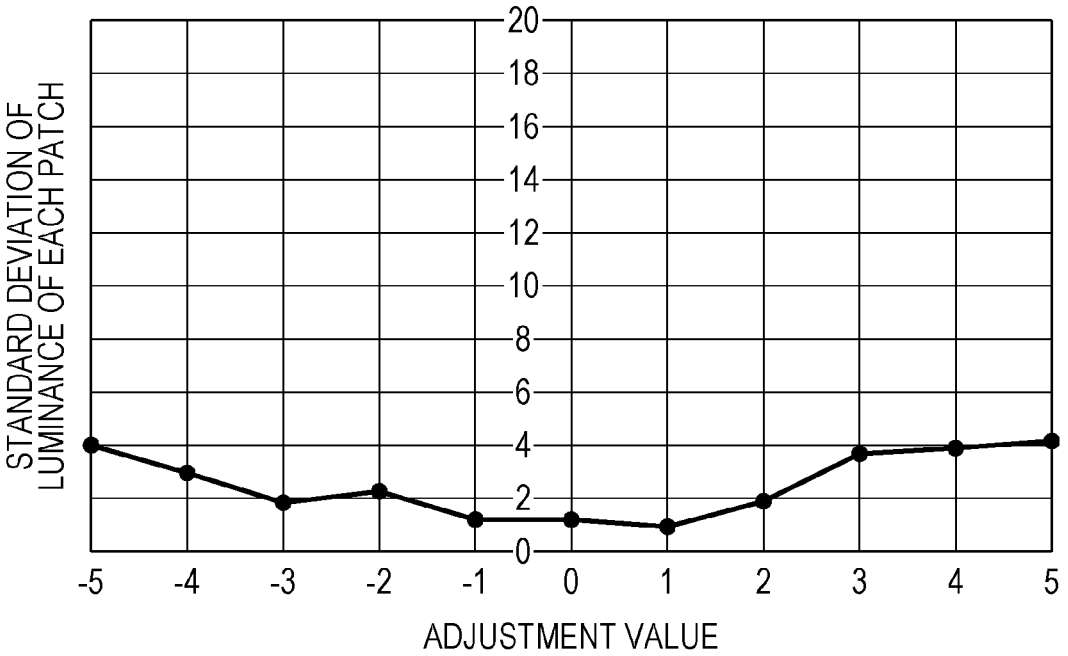

In the first embodiment, the luminance values of the solid blue test patterns are used in steps S7 to S10 in FIG. 6. However, the process from steps S7 to S8 in FIG. 6 may be performed upon the solid blue test patterns, and the process from steps S9 to S10 may be performed using the luminance values of half-tone test patterns illustrated in FIGS. 4 and 5. That is, in the change from the insufficiency of a secondary transfer voltage, the appropriate level of a secondary transfer voltage, and to the somewhat excessive level of a secondary transfer voltage (the change from the adjustment value of −5 to the adjustment value of 3 in FIGS. 8A and 8B), a secondary transfer stable region and candidates for an adjustment value are determined using solid blue test patterns to which a large amount of toner is secondarily transferred. In this embodiment, the amount of toner in the case of solid blue is 0.8 to 1.1 mg/cm^2. To detect which of candidates for an adjustment value in the region corresponds to the point at which the variation in the amount of toner to be secondarily transferred starts to occur under the influence of electric discharge due to an excessive secondary transfer voltage, half-tone test patterns are used to which a smaller amount of toner is secondarily transferred than to a solid blue patch. The amount of toner in the case of half-tone is 0.18 to 0.25 mg/cm^2. As a result, the sensitivity for the insufficiency and excess of a secondary transfer voltage is increased, and the accuracy of deciding an optimum secondary transfer voltage is improved. FIG. 10A illustrates the change in luminance values at four points on each test pattern (half-tone patch) with respect to an adjustment value. FIG. 10B illustrates the change in the standard deviation of luminance values at four points on each test pattern with respect to an adjustment value. As illustrated in FIG. 10B, the standard deviation of luminance data of a half-tone test pattern which is obtained with the adjustment value of 1 is the smallest of the four standard deviations obtained with the candidate adjustment values of 0 to 3 selected in steps S7 to S8. As compared with the case where the process from steps S9 to 10 is performed using solid blue test patterns, the sensitivity is increased for the point at which the influence of electric discharge due to an excessive secondary transfer voltage on secondary transferability starts, and the stability of the amount of toner to be secondarily transferred is further improved.

One of groups of multiple test patterns with which the smallest standard deviation is obtained is selected as a group enabling a stable density in this embodiment. However, multiple groups satisfying predetermined conditions may be selected as groups enabling a stable density. For example, multiple groups with which a standard deviation less than or equal to a predetermined threshold value is obtained are extracted as groups enabling a stable density, and a secondary transfer voltage may be decided on the basis of the standard deviations of test patterns included in the extracted groups.

The decision of a secondary transfer stable region (the selection of a candidate group) and the decision of a secondary transfer voltage are performed on the basis of the standard deviation of density information (luminance information) of a test pattern in this embodiment, but the present disclosure is not limited thereto. For example, the average of luminance values may be used instead of the standard deviation of a luminance value. That is, from the average of luminance values of test patterns included in each group, a luminance average (index value) of the group is calculated. On the basis of the index value calculated for each group, the determination of whether density is stable may be performed. Since the decision of a secondary transfer stable region (the selection of a candidate group) is performed on the basis of the index value of each group as above, the decision of a secondary transfer stable region can be accurately performed. In addition, since a secondary transfer voltage is set on the basis of the dispersion information (standard deviation) of test patterns in the extracted candidate group, the setting of an excessive transfer voltage can be prevented.

Adjustment Flow in Second Embodiment

Figure 11A:
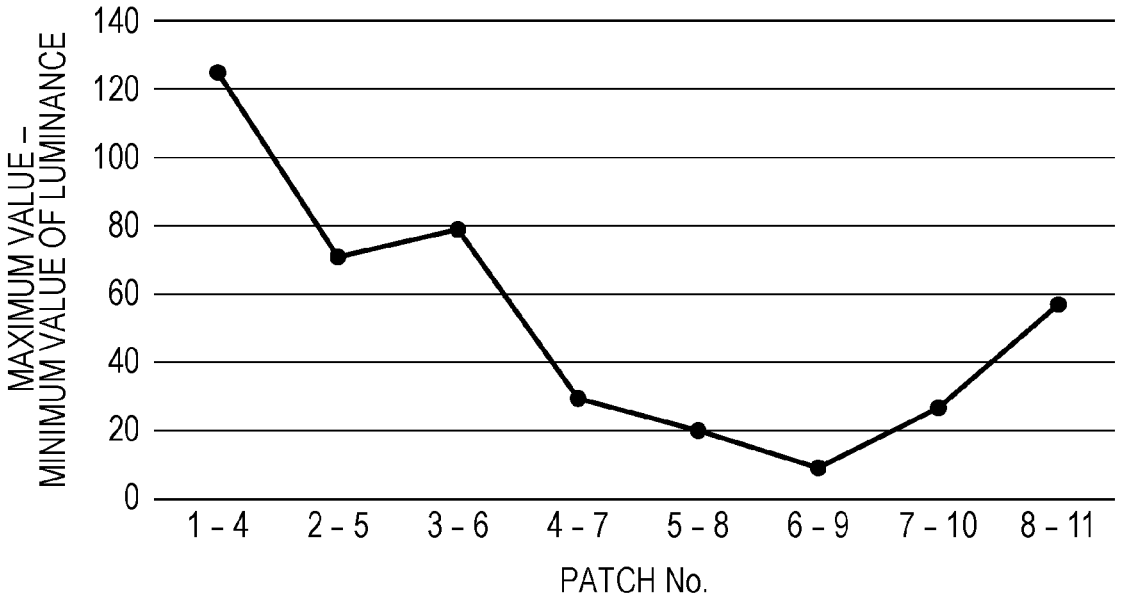
FIGS. 11A and 11B are diagrams describing an example of the secondary transfer voltage adjustment mode in a second embodiment.
Figure 11B:
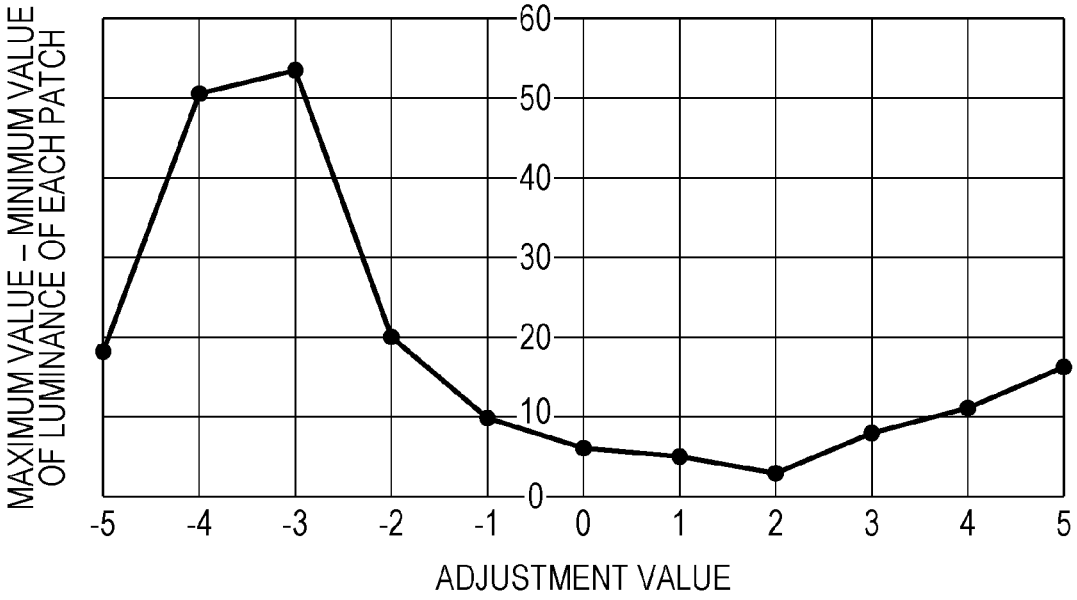

In the second embodiment, the difference (variation) between the maximum luminance value and the minimum luminance value in each group of four test patterns is derived as illustrated in step S7 in FIG. 6. The sixteen pieces of data of luminance values of four test patterns obtained with the adjustment values of −5 to −2 in FIG. 11B are set as a single group, and the difference between the maximum luminance value and the minimum luminance value is derived using these pieces of data. Subsequently, using the sixteen pieces of data of luminance values of four test patterns obtained with the adjustment values of −4 to −1, the difference between the maximum luminance value and the minimum luminance value is derived. FIG. 11A illustrates the change in the difference between the maximum luminance value and the minimum luminance value. For example, the test patterns obtained with the adjustment values of −5 to −2 correspond to patch No. 1-4 in the horizontal axis in FIG. 11A, the test patterns obtained with the adjustment values of −4 to −1 correspond to patch No. 2-5, and the test patterns obtained with the adjustment values of 2 to 5 correspond to patch No. 8-11. The differences between the maximum luminance value and the minimum luminance value of the respective groups are plotted in the vertical axis. As illustrated in FIG. 11A, the difference between the maximum luminance value and the minimum luminance value of the group having patch No. 6-9, that is, the group corresponding to the adjustment values of 0 to 3, is the smallest, and this group is determined to be a region where a density is stable (step S8 in FIG. 6). In this embodiment, the group with patch No. 6-9, which is the group of test patterns obtained with the adjustment values of 0 to 3, has a small difference between the maximum luminance value and the minimum luminance value and is therefore selected. Among the adjustment values of 0 to 3, the adjustment value of 0 with which the lowest secondary transfer voltage is set may be decided as an optimal secondary transfer voltage, but a process is further performed in this embodiment.

Subsequently, the four differences between the maximum luminance value and the minimum luminance value of the respective test patterns (patches) included in the group (corresponding to the adjustment values of 0 to 3) are derived (step S9 in FIG. 6). FIG. 11B illustrates the change in the difference between the maximum luminance value and the minimum luminance value among the four luminance values of each test pattern (patch). It has been determined in step S8 in FIG. 6 that the group corresponding to the adjustment values of 0 to 3 is a region where a density is stable. In this embodiment, it is determined that the adjustment value of 2 in the group is optimum with which the difference between the maximum luminance value and the minimum luminance value of the test pattern (patch) is the smallest of the four differences between the maximum luminance value and the minimum luminance value of the respective test patterns (step S10 in FIG. 6). For example, since the recording medium shared voltage Vp obtained in this environment is 2500 V, Vb obtained as a result of ATVC is 1000 V, and the level of the adjustment value of 1 is 150 V, 3800 V is decided as an optimum secondary transfer voltage for an image formation job (step S11 in FIG. 6).

In the second embodiment, the luminance values of the solid blue test patterns are used in steps S7 to S10 in FIG. 6. However, the process from steps S7 to S8 in FIG. 6 may be performed upon the solid blue test patterns, and the process from steps S9 to S10 may be performed using the luminance values of half-tone test patterns illustrated in FIGS. 4 and 5. That is, in the change from the insufficiency of a secondary transfer voltage, the appropriate level of a secondary transfer voltage, and to the somewhat excessive level of a secondary transfer voltage (the change from the adjustment value of −5 to the adjustment value of 3 in FIG. 11B), a secondary transfer stable region and candidates for an adjustment value are determined using solid blue test patterns to which a large amount of toner is secondarily transferred. In this embodiment, the amount of toner in the case of solid blue is 0.8 to 1.1 mg/cm^2. To detect which of candidates for an adjustment value in the region corresponds to the point at which the variation in the amount of toner to be secondarily transferred starts to occur under the influence of electric discharge due to an excessive secondary transfer voltage, half-tone test patterns are used to which a smaller amount of toner is secondarily transferred than to a solid blue patch. The amount of toner in the case of half-tone is 0.18 to 0.25 mg/cm^2. As a result, the sensitivity for the insufficiency and excess of a secondary transfer voltage is increased, and the accuracy of deciding an optimum secondary transfer voltage is improved.

Figure 12A:
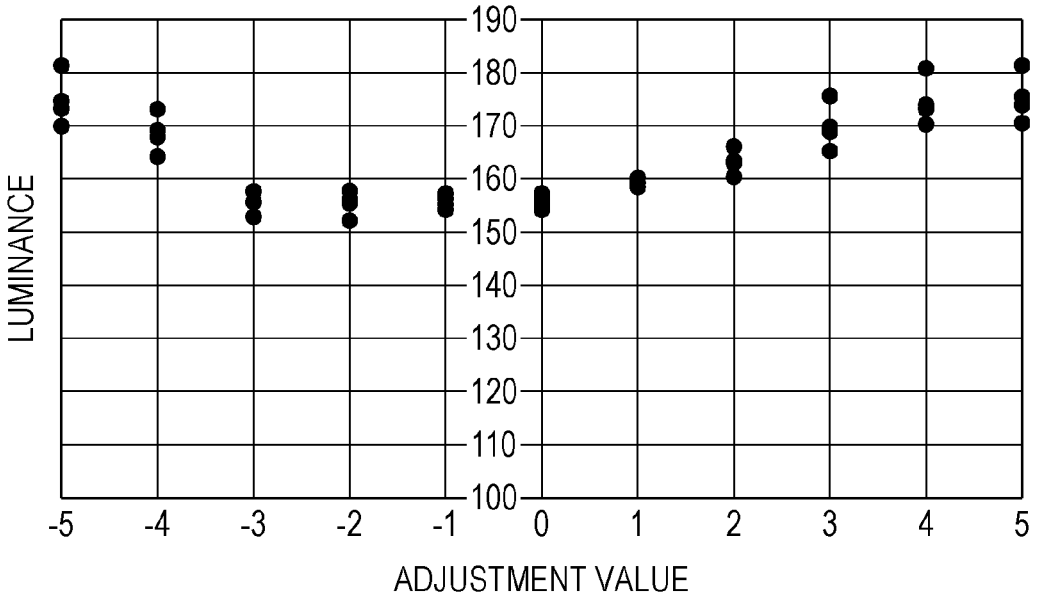
FIGS. 12A and 12B are diagrams describing an example of the secondary transfer voltage adjustment mode in the second embodiment.
Figure 12B:
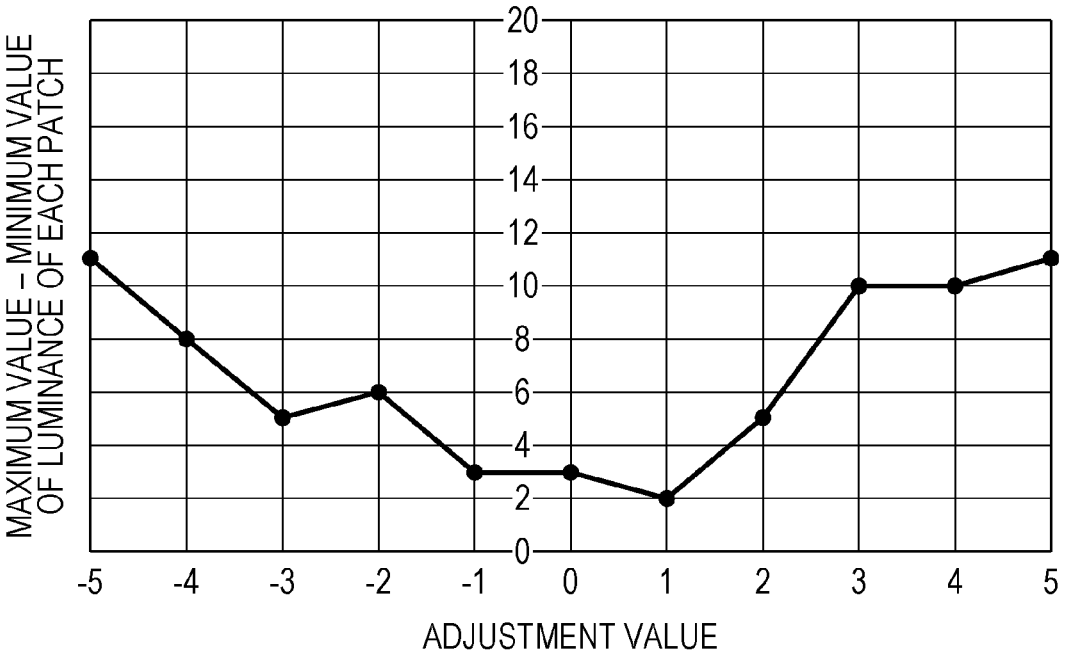

FIG. 12A illustrates the change in luminance values at four points on each test pattern (half-tone patch) with respect to an adjustment value. FIG. 12B illustrates the change in the difference between the maximum luminance value and the minimum luminance value at four points on each test pattern with respect to an adjustment value. As illustrated in FIG. 12B, the difference between the maximum luminance value and the minimum luminance value of a half-tone test pattern which is obtained with the adjustment value of 1 is the smallest of the four differences obtained with the candidate adjustment values of 0 to 3 selected in steps S7 to S8. As compared with the case where the process from steps S9 to 10 is performed using solid blue test patterns, the sensitivity is increased for the point at which the influence of electric discharge due to an excessive secondary transfer voltage on secondary transferability starts, and the stability of the amount of toner to be secondarily transferred is further improved.

Adjustment Flow in Third Embodiment

Figure 13A:
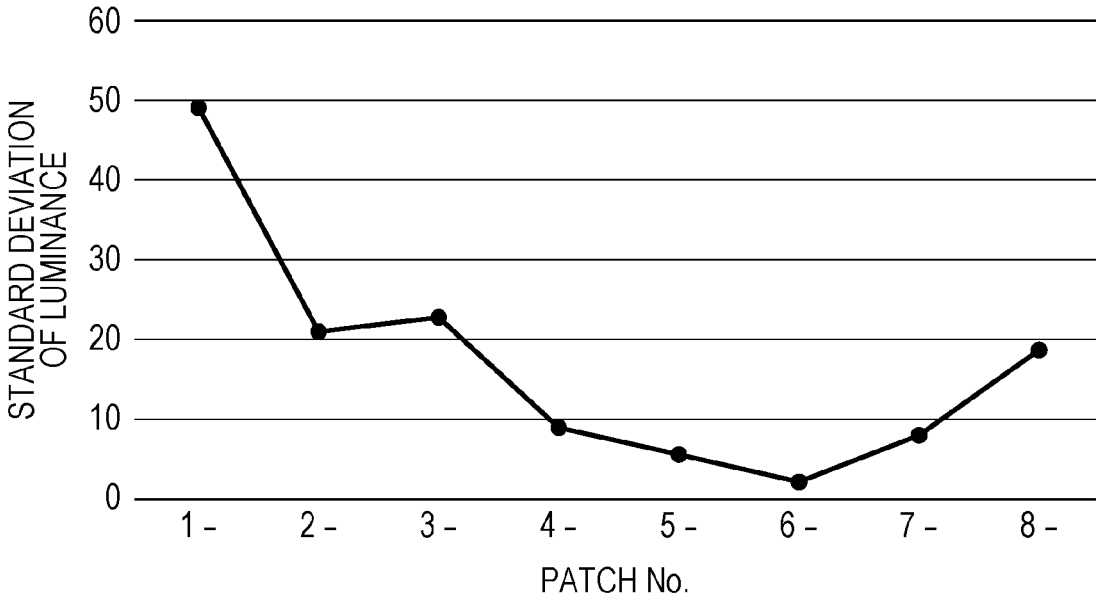
FIGS. 13A and 13B are diagrams describing an example of the secondary transfer voltage adjustment mode in a third embodiment.

In the third embodiment, a standard deviation is derived as the variation in luminance value of a group of four test patterns as illustrated in step S7 in FIG. 6. At the time of the acquisition of luminance value data in step S6, the average of four luminance values of the respective test patterns is calculated. FIG. 8A illustrates the change in the average of luminance values with respect to an adjustment value. In this embodiment, when the average of luminance values is greater than 60, four adjacent test patterns are not selected. In this case, four alternate test patterns are selected, the sixteen pieces of data of four luminance values of the respective test patterns are set as a single group, and a standard deviation is derived using these pieces of data. For example, in this embodiment, the average of luminance values in the case of the adjustment value of −5 in FIG. 8A is greater than 60, and, in the region corresponding to the adjustment value, a secondary transfer voltage is insufficient and the amount of toner to be secondarily transferred is unstable. In this case, using the sixteen pieces of data of four luminance values of the respective test patterns obtained with the adjustment values of −5, −3, −1, and −0, a standard deviation is derived. This standard deviation is plotted as a "patch No. 1-" in FIG. 13A. The average of luminance values in the case of the adjustment value of −4 in FIG. 8A is similarly greater than 60, and, in the region corresponding to the adjustment value, a secondary transfer voltage is insufficient and the amount of toner to be secondarily transferred is unstable. Also in this case, using the sixteen pieces of data of four luminance values of the respective test patterns obtained with the adjustment values of −4, −2, 0, and 1, a standard deviation is derived. This standard deviation is plotted as a "patch No. 2-" in FIG. 13A. The average of luminance values in the case of the adjustment value of −3 in FIG. 8A is similarly greater than 60, and, in the region corresponding to the adjustment value, a secondary transfer voltage is insufficient and the amount of toner to be secondarily transferred is unstable. Also in this case, using the sixteen pieces of data of four luminance values of the respective test patterns obtained with the adjustment values of −3, −1, 1, and 3, a standard deviation is derived. This standard deviation is plotted as a "patch No. 3-" in FIG. 13A. On the other hand, since the averages of luminance values in the case of the adjustment values of −2 to 2 in FIG. 8A are less than or equal to 60, a standard deviation is derived using the sixteen pieces of data of four luminance values of the respective test patterns obtained with, for example, the adjustment values of −2, −1, 0, and 1. This standard deviation is plotted as a "patch No. 4-" in FIG. 13A. For example, a standard deviation is derived using the sixteen pieces of data of four luminance values of the respective test patterns obtained with the adjustment values of 2, 3, 4, and 5. This standard deviation is plotted as a "patch No. 8-" in FIG. 13A. Since the group of four test patterns cannot be formed any more, step S7 in FIG. 6 ends. As illustrated in FIG. 13A, the standard deviation (variation) of the luminance value of the group having patch No. 6-, that is, the group obtained with the adjustment values of 0 to 3, is the smallest, and this group is determined to be a region where a density is stable (step S8 in FIG. 6). In this embodiment, the group with patch No. 6-, which is the group of test patterns obtained with the adjustment values of 0 to 3, has a small standard deviation of a luminance value and is therefore selected. Among the adjustment values of 0 to 3, the adjustment value of 0 with which the lowest secondary transfer voltage is set may be decided as an optimal secondary transfer voltage, but a process is further performed in this embodiment.

Figure 13B:
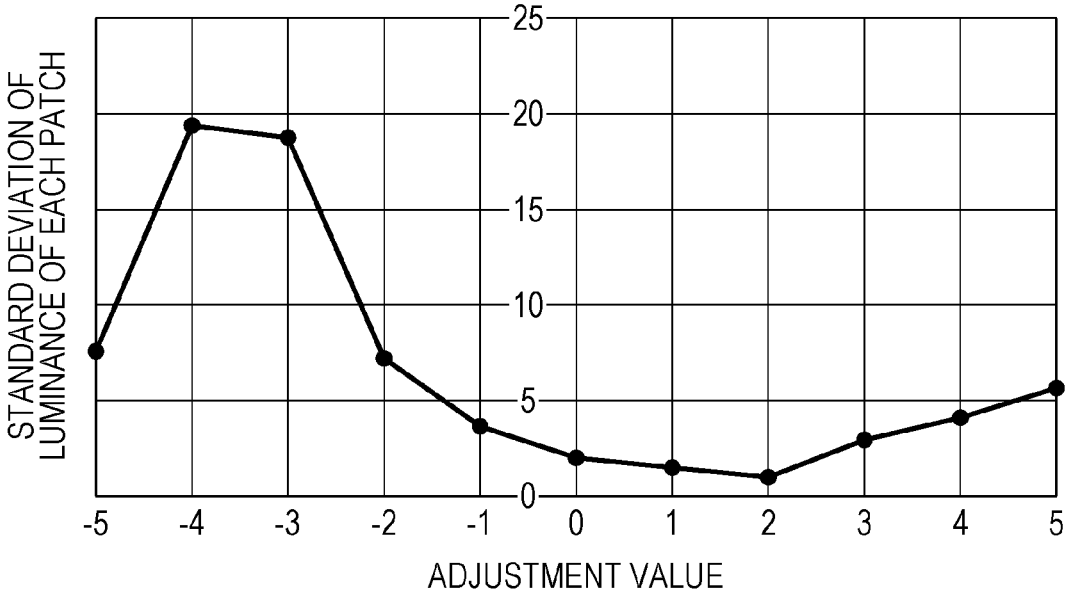

Subsequently, the four standard deviations (variations) of luminance values of the respective test patterns (patches) included in the group (corresponding to the adjustment values of 0 to 3) are derived (step S9 in FIG. 6). FIG. 13B illustrates the change in the standard deviation of four luminance values of each test pattern (patch). It has been determined in step S8 in FIG. 6 that the group corresponding to the adjustment values of 0 to 3 is a region where a density is stable. In this embodiment, it is determined that the adjustment value of 2 in the group is optimum with which the standard deviation (variation) of the luminance value of the test pattern (patch) is the smallest of the four standard deviations of luminance values of the respective test patterns (step S10 in FIG. 6). For example, since the recording medium shared voltage Vp obtained in this environment is 2500 V, Vb obtained as a result of ATVC is 1000 V, and the level of the adjustment value of 1 is 150 V, 3800 V is decided as an optimum secondary transfer voltage for an image formation job (step S11 in FIG. 6).

In the third embodiment, the luminance values of the solid blue test patterns are used in steps S7 to S10 in FIG. 6. However, the process from steps S7 to S8 in FIG. 6 may be performed upon the solid blue test patterns, and the process from steps S9 to S10 may be performed using the luminance values of half-tone test patterns illustrated in FIGS. 4 and 5. That is, in the change from the insufficiency of a secondary transfer voltage, the appropriate level of a secondary transfer voltage, and to the somewhat excessive level of a secondary transfer voltage, a secondary transfer stable region and candidates for an adjustment value are determined in steps S7 to S8 using solid blue test patterns to which a large amount of toner (0.8 to 1.1 mg/cm^2 in this embodiment) is secondarily transferred. That is, in the change from the adjustment value of −5 to the adjustment value of 3 in FIGS. 8A and 8B, a secondary transfer stable region and candidates for an adjustment value are determined using solid blue test patterns to which a large amount of toner is secondarily transferred. In steps S9 to S10, determination is performed using half-tone test patterns to which a smaller amount of toner (0.18 to 0.25 mg/cm^2 in this embodiment) is secondarily transferred than to a solid blue test pattern. As a result, it can be detected which of candidates for an adjustment value in the region corresponds to the point at which the variation in the amount of toner to be secondarily transferred starts to occur under the influence of electric discharge due to an excessive secondary transfer voltage.

As a result, the sensitivity for the insufficiency and excess of a secondary transfer voltage is increased, and the accuracy of deciding an optimum secondary transfer voltage is improved. FIG. 10A illustrates the change in luminance values at four points on each test pattern (half-tone patch) with respect to an adjustment value. FIG. 10B illustrates the change in the standard deviation of luminance values at four points on each test pattern with respect to an adjustment value. As illustrated in FIG. 10B, the standard deviation of luminance data of a half-tone test pattern which is obtained with the adjustment value of 1 is the smallest of the four standard deviations obtained with the candidate adjustment values of 0 to 3 selected in steps S7 to S8. As compared with the case where the process from steps S9 to 10 is performed using solid blue test patterns, the sensitivity is increased for the point at which the influence of electric discharge due to an excessive secondary transfer voltage on secondary transferability starts, and the stability of the amount of toner to be secondarily transferred is further improved.

There can be provided an image forming apparatus capable of preventing the setting of an excessive transfer voltage while suppressing the occurrence of insufficient transfer.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc™ (BD)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-060650 filed Mar. 31, 2021, which is hereby incorporated by reference herein in its entirety.

What is claimed is:

1. An image forming apparatus comprising:

an image carrier configured to carry a toner image;

an image forming unit configured to form the toner image on the image carrier;

an intermediate transfer belt on which the toner image formed on the image carrier is transferred;

a transfer member configured to transfer the toner image transferred on the intermediate transfer belt on a recording medium;

a power supply configured to apply a transfer voltage to the transfer member;

a sensor configured to detect the toner image formed on the recording medium; and a control unit configured to execute an adjustment mode for adjusting the transfer voltage to be applied to the transfer member in transferring the toner image from the intermediate transfer belt on a recording material during non-image formation, wherein, in the adjustment mode, the control unit controls the power supply to transfer a plurality of test toner images to the recording material by applying a plurality of levels of test voltages to the transfer member, and adjusts the transfer voltage to be applied to the transfer member based on a detection result of detecting the plurality of test toner images by the sensor, and wherein, in the adjustment mode, the control unit (i) sets a plurality of groups consisting of test toner images extracted from the plurality of test toner images, (ii) acquires an index value for each of the plurality of groups based on the detection result of detecting the plurality of test toner images by the sensor, (iii) extracts a specific group from the plurality of groups based on the index value, (iv) extracts a specific test toner image from test toner images included the specific group, and (v) adjusts the transfer voltage to be applied based on a test voltage of the specific test toner image.

2. The image forming apparatus according to claim 1, wherein the plurality of groups includes a first group and a second group adjacent to the first group, and wherein the first group includes a first test toner image and a second test toner image, and the second group includes the second test toner image and a third test toner image.

3. The image forming apparatus according to claim 1, wherein the control unit adjusts the transfer voltage based on information about a variation in luminance information of test toner images included in the specific group.

4. The image forming apparatus according to claim 1, wherein the index value is information about a variation in luminance information of respective test toner images included in each of the plurality of groups.

5. The image forming apparatus according to claim 1, wherein the index value is a standard deviation of luminance information of respective test toner images included in each of the plurality of groups.

6. The image forming apparatus according to claim 1, wherein the index value is an average of luminance information of respective test toner images included in each of the plurality of groups.

7. The image forming apparatus according to claim 1, wherein the control unit extracts the specific test toner image from the test toner images included the specific group based on information about a variation in luminance information of test toner images included in the specific group.

8. The image forming apparatus according to claim 1, wherein the control unit extracts the specific test toner image from the test toner images included the specific group based on a test voltage of the test toner images included in the specific group.

* * * * *